US009032588B2

(12) United States Patent
Chen

(10) Patent No.: US 9,032,588 B2
(45) Date of Patent: May 19, 2015

(54) COVERING OF BUILDING OPENING

(71) Applicant: NIEN MADE ENTERPRISE CO., LTD., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/261,634

(22) Filed: Apr. 25, 2014

(65) Prior Publication Data

US 2014/0231031 A1 Aug. 21, 2014

Related U.S. Application Data

(63) Continuation-in-part of application No. 13/788,163, filed on Mar. 7, 2013, now Pat. No. 8,869,351.

(51) Int. Cl.

| | |
|---|---|
| ***E05D 15/06*** | (2006.01) |
| ***E06B 7/28*** | (2006.01) |
| ***E06B 9/06*** | (2006.01) |
| ***E05D 15/26*** | (2006.01) |

(52) U.S. Cl.

CPC ..... *E06B 7/28* (2013.01); *E06B 9/0638* (2013.01); *E06B 9/0669* (2013.01); *E05D 15/264* (2013.01); *E05Y 2201/214* (2013.01); *E05Y 2201/22* (2013.01); *E05Y 2201/232* (2013.01); *E05Y 2201/24* (2013.01); *E05Y 2900/146* (2013.01); *E05Y 2800/00* (2013.01); *E05Y 2900/00* (2013.01)

(58) Field of Classification Search

CPC ... A47H 2023/025; A47H 1/04; A47H 15/00; A47H 15/02; A47H 15/04; E06B 9/36; E06B 3/42; E06B 3/46; E06B 3/4609; E06B 3/4636; E06B 3/481; E05D 15/06; E05D 15/0621; E05D 15/0626; E05D 15/063; E05D 15/0652; E05D 15/26; E05D 15/262; E05D 15/264; E05Y 2900/131; E05Y 2900/132; E05Y 2900/142

USPC ..... 16/90, 91, 94 R, 96 R, 95 R, 97, 16/101–107, 87 R, 84 R, 87.6 R, 87.8, 273; 160/185, 199, 196.1, 195; 49/404, 409, 49/410, 411, 412, 420, 421–425, 453, 455, 49/126, 127, 128, 394, 130; 52/243.1

See application file for complete search history.

(56) References Cited

U.S. PATENT DOCUMENTS

| | | | | | |
|---|---|---|---|---|---|
| 2,957,197 | A | * | 10/1960 | Johnson, Jr. | 16/105 |
| 2,982,988 | A | * | 5/1961 | Blackmer | 16/97 |
| 3,057,005 | A | * | 10/1962 | Dishaw | 16/105 |
| 3,118,170 | A | * | 1/1964 | Zollinger | 16/105 |

(Continued)

*Primary Examiner* — Chuck Mah

(74) *Attorney, Agent, or Firm* — Ming Chow; Sinorica, LLC

(57) ABSTRACT

A covering of a building opening includes a rail, a first sash having a guiding slot, a second sash hinged with the first sash and having a center of rotation at an end thereof, a pulley assembly, and a restricting assembly. The pulley assembly is movably received in the rail and has a rod. The rod has a protrusion section extending out of the rail, and the protrusion section enters and leaves the guiding slot while the pulley assembly is moving. The restricting assembly has a moving member and a locking base. The moving member is provided on one of the first sash and the second sash, and the locking base is provided on the other. The moving member is moved by the rod and engages the locking base when the rod leaves the guiding slot.

17 Claims, 32 Drawing Sheets

(56) References Cited

U.S. PATENT DOCUMENTS

| | | | | | |
|---|---|---|---|---|---|
| 3,138,474 | A * | 6/1964 | Reiss et al. | 160/206 |
| 3,193,871 | A * | 7/1965 | Foltz | 210/98 |
| 3,403,954 | A * | 10/1968 | Williams | 312/351 |
| 3,479,682 | A * | 11/1969 | McNinch | 16/97 |
| 3,692,083 | A * | 9/1972 | Swanson et al. | 160/206 |
| 3,757,384 | A * | 9/1973 | Rusch | 16/97 |
| 3,813,728 | A * | 6/1974 | Johnson | 16/97 |
| 3,829,929 | A * | 8/1974 | Foltz et al. | 16/97 |
| 4,945,605 | A * | 8/1990 | Haab et al. | 16/97 |
| 6,209,171 | B1 * | 4/2001 | Pelletier et al. | 16/97 |
| 6,983,512 | B2 * | 1/2006 | De Oliveira | 16/97 |
| 7,117,559 | B1 * | 10/2006 | Barber | 16/97 |
| 7,451,802 | B2 * | 11/2008 | Cianciolo et al. | 160/211 |
| 8,046,872 | B2 * | 11/2011 | Burgess et al. | 16/97 |
| 8,402,606 | B1 * | 3/2013 | Tsai | 16/49 |
| 8,819,993 | B1 * | 9/2014 | Chen | 49/125 |
| 2012/0186046 | A1 * | 7/2012 | Pelekanos | 16/87 R |

* cited by examiner

COVERING OF BUILDING OPENING

RELATED APPLICATION

This application is a continuation-in-part of U.S. patent application Ser. No. 13/788,163 filed on Mar. 7, 2013 which claimed a foreign priority to China patent application number 201220739132.2, filed on Dec. 28, 2012.

BACKGROUND OF THE INVENTION

1. Field of the Invention

The present invention relates generally to a covering of a building's opening, and more particularly to a detachable hanger of a covering of a building's opening.

2. Description of the Related Art

A covering for an opening of a building, such as window or door, has various types. Take a window covering for example, the common type of the window covering has two sliding or hinged sashes. In this type of window covering, the sashes take some space of the window opening. It is bad for ventilation.

Another window covering is similar to a casement window, having two hinged sashes, one of which is pivoted on the frame, and the other one of which is slidably engaged with a rail. Slide the sash will fold the sashes. In this window covering, the rail is straight, and the sash can't be moved when the folded sashes fold up. A new window covering provides a warp rail, with which the folded sashes are moved off the window and attached to the wall beside the window. It is easy to understand that the warp rail is expensive and is difficult to manufacture. Furthermore, the warp rail makes the sashes move in a strange way. It is not good looking.

The folded sashes may be moved continuously to be against the wall beside the opening. However, since the folded sashes are not engaged with each other, the sash, which is not connected to the rail will swing freely and, sometime, hits the wall.

SUMMARY OF THE INVENTION

The primary objective of the present invention is to provide a covering of a building opening, in which the covering may be totally opened and kept in a safe condition to avoid hurting people walking through or by.

According to the objective of the present invention, a covering of a building opening includes a rail, a first sash having a guiding slot, a second sash hinged with the first sash and having a center of rotation at an end thereof, a pulley assembly, and a restricting assembly. The pulley assembly is movably received in the rail and has a rod. The rod has a protrusion section extending out of the rail, and the protrusion section is able to enter and leave the guiding slot of the first sash. The restricting assembly has a moving member and a locking base. The moving member is provided on one of the first sash and the second sash, and the locking base is provided on the other sash. The moving member is moved by the rod and engages the locking base when the rod leaves the guiding slot.

In an embodiment, the first sash has a sash frame, on which the guiding slot is provided; the moving member is provided in the sash frame to be moved between a first position and a second position; the moving member is away from the rod when the moving member is moved to the first position, and is moved by the rod when the moving member is moved to the second position, and while the rod is moving out of the guiding slot; and the locking base is provided on the second sash and associated with the moving member. In an embodiment, the restricting assembly has a tube, on which the moving member is provided; the moving member is turned between a third position and a fourth position; the rod moves the moving member to the fourth position from the third position while the rod is leaving the guiding slot; the tube has a contacting portion extending out of the sash frame; the locking base has a slot, and the contacting portion is detachably engaged with the slot to keep the moving member locked at the second position.

In an embodiment, the tube turns along with the moving member; the contacting portion of the tube has a connector; the connector enters the slot when the moving member is moved to the third position, and touches an inner sidewall of the slot to make the tube unable to disengage the locking base when the moving member is moved to the fourth position.

In an embodiment, the tube has an engaging section, and the moving member has a pipe and a guiding portion; the pipe has an engaging hole, which is complementary to the engaging section; the pipe is connected to the tube through an engagement of the engaging section and the engaging hole; the guiding portion is connected to the pipe to touch the protrusion section of the rod when the moving member is moved to the second position.

In an embodiment, the restricting assembly further has a positioning member provided in the sash frame of the first sash, and the moving member further includes a first positioning slot and a second positioning slot on an outer side of the pipe; the positioning member is engaged with the first positioning slot when the moving member is moved to the third position, and the positioning member is engaged with the second positioning slot to keep the moving member at the fourth position when the moving member is moved to the fourth position.

In an embodiment, the restricting assembly further has a stop member on a side thereof; the stop member restricts the rod within the guiding slot when the moving member is moved to the first position.

In an embodiment, the stop member is fitted to the tube and it can turn freely; a torsion spring is fitted to the tube to urge the stop member and the moving member respectively; the sash frame holds the stop member at a fixed position when the tube is turning, and the torsion spring urges the moving member toward the fourth position.

In an embodiment, the stop member has a ring and a block; the ring has a round hole to engage the tube, and the block is connected to the ring.

In an embodiment, the restricting assembly has a pushing member with opposite ends against an inner wall of the sash frame and the tube respectively; the pushing member drives the moving member toward the first position.

In an embodiment, the first sash has a sash frame; the locking base is connected to the sash frame of the first sash, and has the guiding slot and a lateral bore; the moving member is provided on the second sash for free rotation; a stop member restricts the rod in the guiding slot; when an end of the moving member passes through the lateral bore and moves the stop member, the rod is able to move the moving member, and then leave the guiding slot.

In an embodiment, the moving member has a body portion, a guiding portion, and a contacting portion; the guiding portion and the contacting portion are connected to the body portion respectively; the body portion is connected to the second sash for free rotation; the guiding portion touches the protrusion section of the rod, and the contacting portion touching an inner wall of the locking base when the moving member moves the stop member.

In an embodiment, the second sash has a fixed board, to which the moving member is connected; the fixed board has a first contacting portion, and the locking base has a second contacting portion; the first contacting portion touches the second contacting portion when the stop member is moved by the moving member.

The present invention further provides a method of opening a covering of a building opening, which includes the following steps:

Move the first sash toward the second sash until the first sash and the second sash are folded and substantially perpendicular to the rail, wherein the rod is received in the guiding slot when the first sash and the second sash are folded and substantially perpendicular to the rail; and Continuously move the first sash and the second sash to turn the first sash and the second sash around the center of rotation until the first sash and the second sash are totally off the opening.

In an embodiment, the end opening of the guiding slot is closed before the first sash and the second sash are folded and substantially perpendicular to the rail, and after that the end opening of the guiding slot is opened.

In an embodiment, the first sash and the second sash are kept in a folded condition while the first sash and the second sash are being moved off the opening.

In an embodiment, the covering further includes a moving member and a locking base; the moving member is provided on one of the first sash and the second sash, and the locking base is provided on the other; the moving member is moved by the rod and engages the locking base when the rod leaves the guiding slot.

Therefore, the covering of the present invention may be totally off the opening to obtain a maximum open size of the opening. Furthermore, no curved frame or rail is needed in our covering, therefore it may avoid people being hurt by the sashes while they are being opened.

DETAILED DESCRIPTION OF THE INVENTION

The detailed description and technical contents of the present invention will be explained with reference to the accompanying drawings. However, the drawings are illustrative only but not used to limit the present invention.

Figure 5:
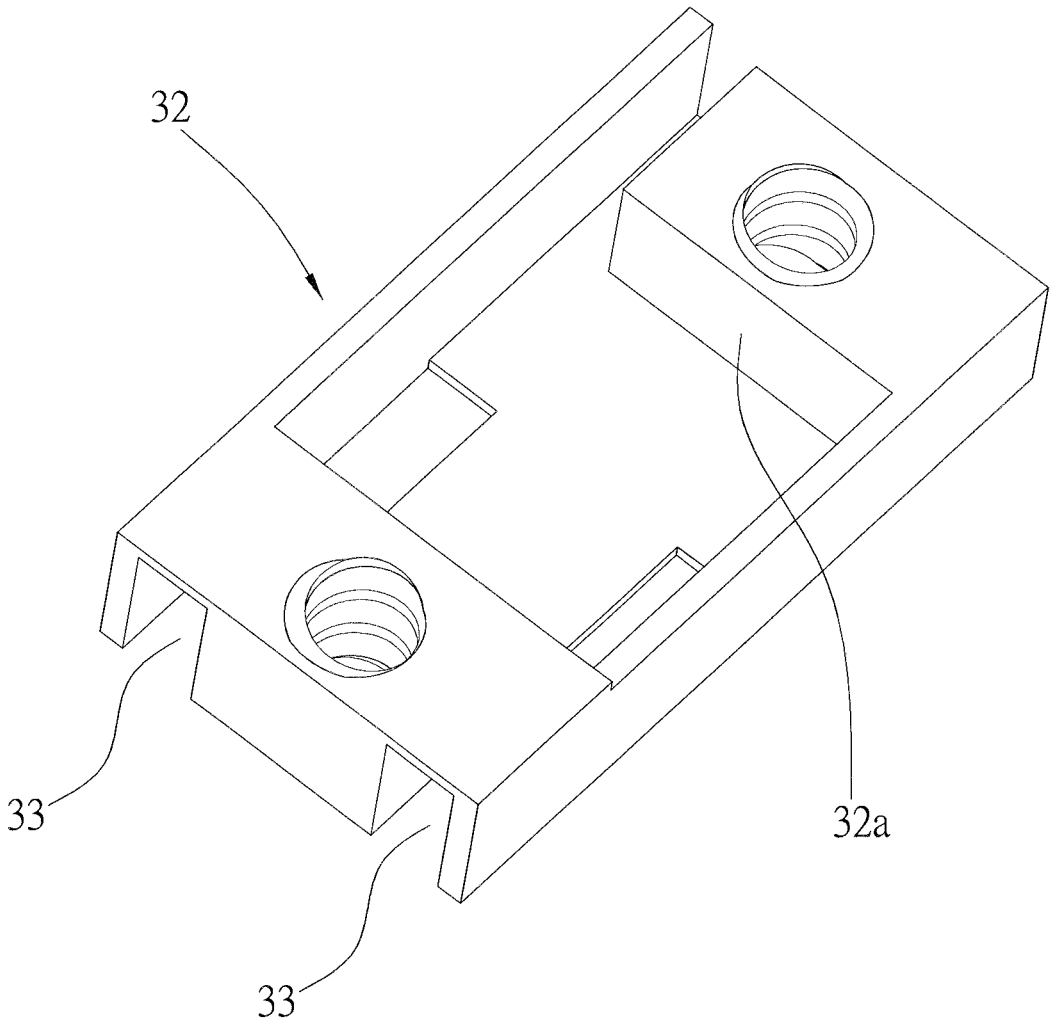
FIG. 5 is a perspective view of the supporting member of the first preferred embodiment of the present invention.
Figure 6:
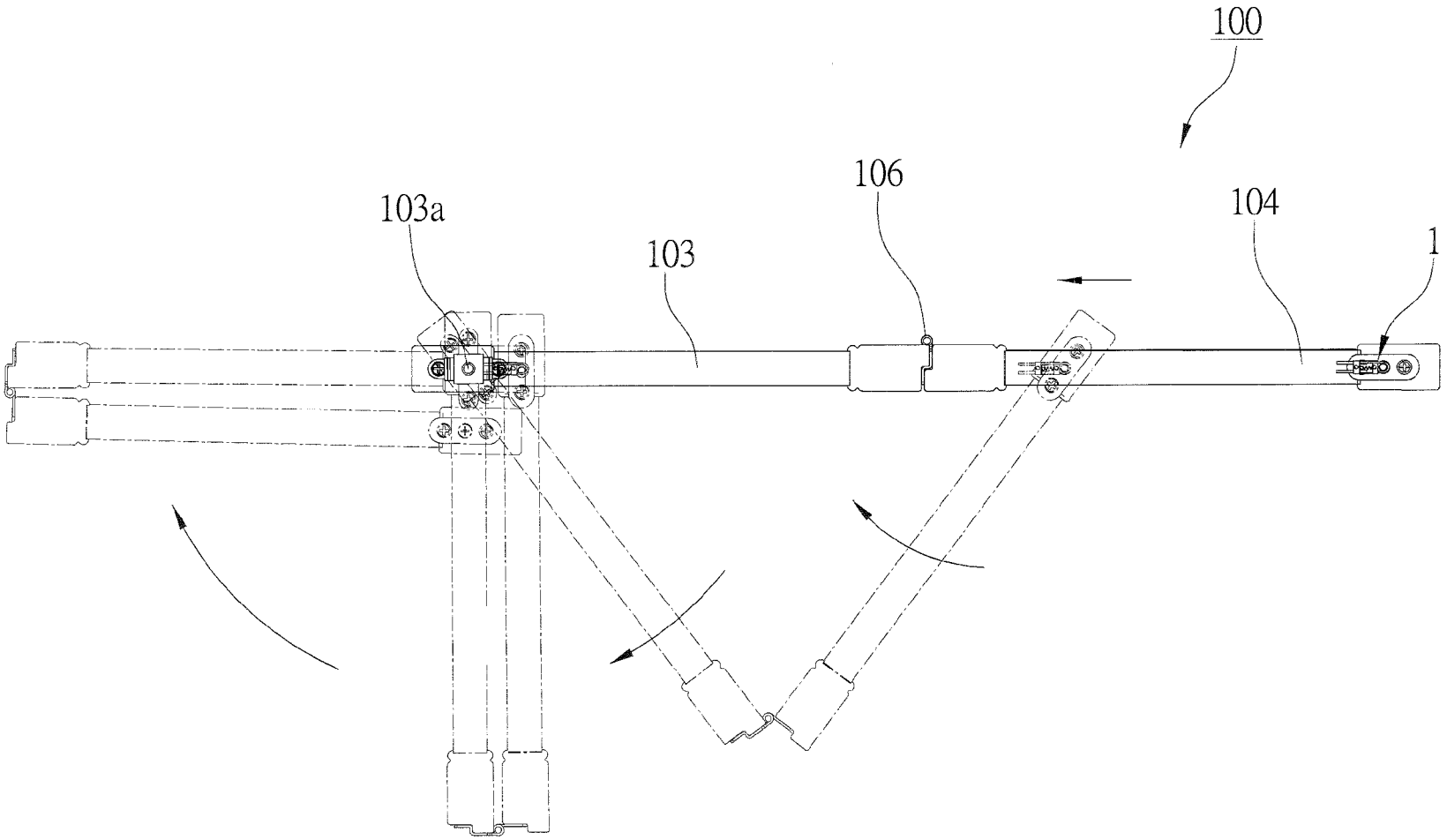
FIG. 6 is a top view of the window covering of the first preferred embodiment of the present invention, showing the movement of the sashes.

FIGS. from FIG. 1 to FIG. 5 show a detachable hanger 1, which is incorporated in a covering, such as window covering or door, of a building's opening, and we take a window covering 100 for example to describe the detachable hanger 1 of the present invention hereunder. The window covering 100 has a window frame 101, a straight rail 102, and two sashes 103, 104. The sash 103 is pivoted on the window frame 101 through a pin 103*a* (FIG. 6), and the sash 104 is connected to the sash 103 through a hinge 106 (FIG. 6). The sash 104 has a sash frame 105, and the sash frame 105 has a top side 105*a*.

The hanger 1 includes a pulley assembly 10, an engaging assembly 20, and a restricting assembly 30.

The pulley assembly 10 has a base 12 and a plurality of pulleys 14. The base 12 has a top section 12*a* and a bottom section 12*b*. The top section 12*a* and the bottom section 12*b* are connected through ribs, and therefore, a space S is formed between the top section 12*a* and the bottom section 12*b*. The pulleys 14 are mounted on the top section 12*a* for free rotation. The pulleys 14 engage the rail 102 so that the base 12 is able to move in the rail 102.

Figure 3:
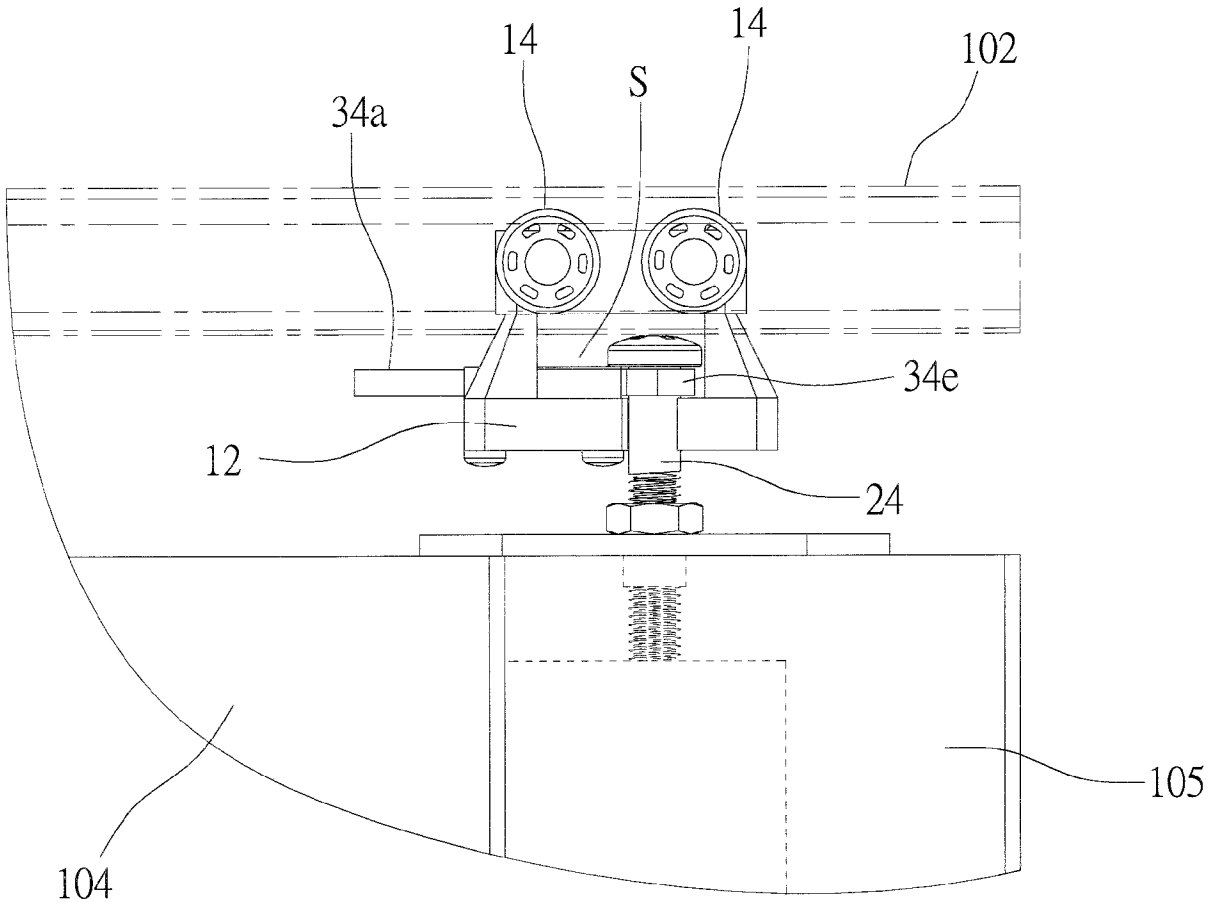
FIG. 3 is a front view of the first preferred embodiment of the present invention.
Figure 4:
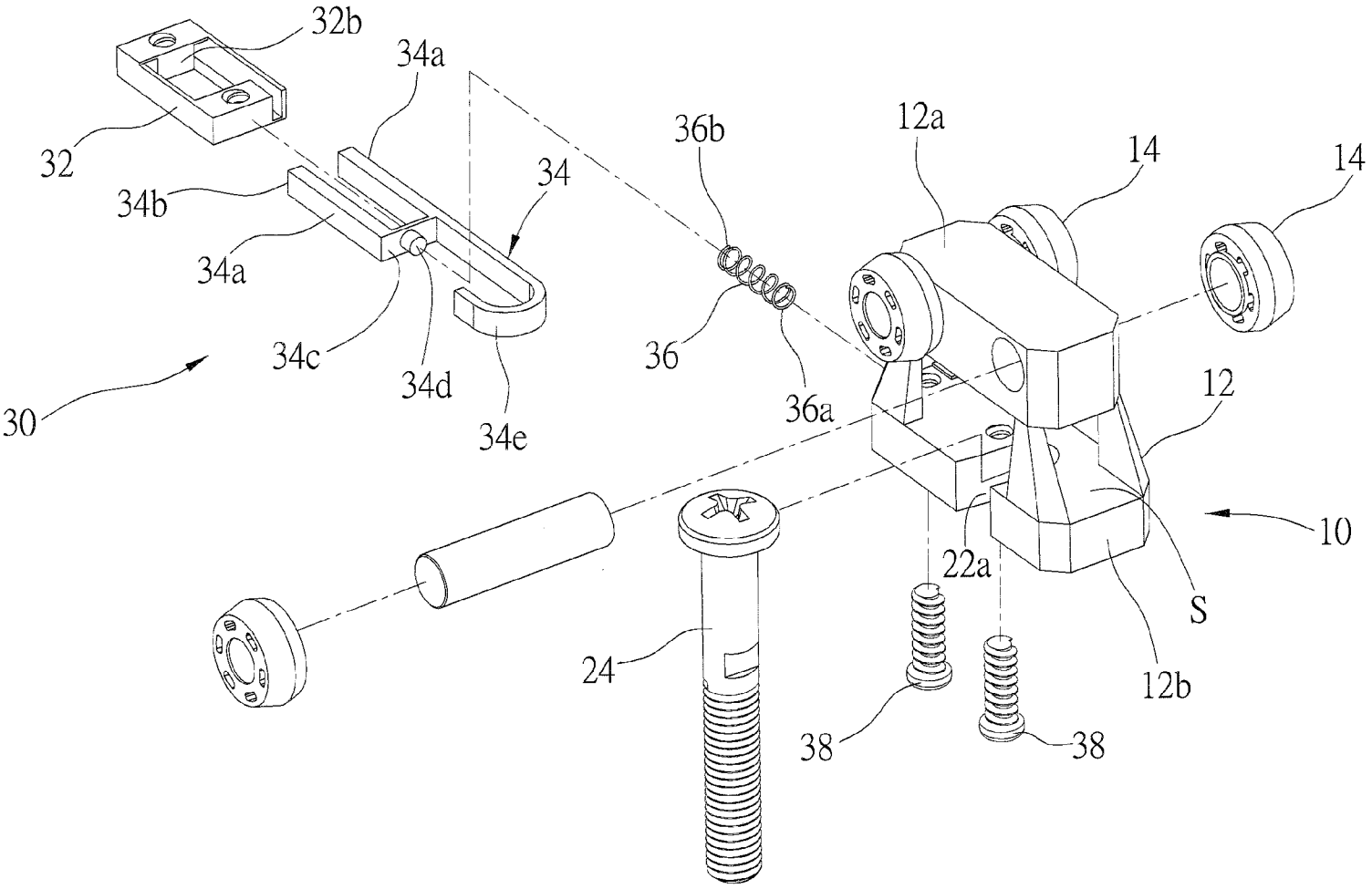
FIG. 4 is an exploded view of the first preferred embodiment of the present invention.

The engaging assembly 20 includes a slot 22 and a rod 24. The slot 22 is provided on the bottom section 12*b* of the base 12. The slot 22 is open at a top and a bottom of the bottom section 12*b* and has an end opening 22*a* at a lateral side of the bottom section 12*b*. The rod 24 is vertical and has an end fixed to the top side 105*a* of the sash frame 105. In an embodiment, the rod 24 is a bolt screwed into a thread hole on the sash frame 105 and engaging the slot 22, and a head of the rod 24 is in the space S, as shown in FIG. 3. The rod 24 is able to move together and within the slot 22 while the sash 104 is moving. The head is bigger than a width of the slot 22 so that the rod 24 only leaves the slot 22 via the end opening 22*a*.

The restricting assembly 30 has a supporting member 32, a switch 34, and an elastic member 36.

The supporting member 32 is a rectangular frame and is fixed to the top of the bottom section 12*b* of the base 12 through two blots 38, and therefore the supporting member 32 is in the space S. As shown in FIG. 5, the supporting member 32 has a recess, and a front stop portion 32*a* and a rear stop portion 32*b* are formed on opposite sidewalls of the recess. The supporting member 32 further has two openings 33 on a rear side thereof. The openings 33 extend through the rear stop portion 32*b*. A passageway is provided beside the front stop portion 32*a* to be an entrance of the recess, and the passageway is aligned with one of the opening 33.

The switch 34 movably engages the supporting member 32. The switch 34 has two parallel arms 34*a*, a base 34*c* connected to ends of the arms 34*a*, a protrusion 34*d* on the base 34*c* opposite to the arms 34*a*, and a hook 34*e* connected to the base 34*c* at the same side with the protrusion 34*d*. The base 34*c* is received within the recess of the supporting member 32 to be moved between the front stop portion 32*a* and the rear stop portion 32*b*. The arms 34*a* pass through the openings 33 and has distal ends extending out of the openings 33 to form an driving portion 34*b*. The hook 34*e* passes through the passageway to have a hook portion out of the supporting member 32.

In an embodiment, the elastic member 36 is a compression spring, having a first end 36*a* urging the front stop portion 32*a* and a second end 36*b* engaging the protrusion 34*d* of the switch 34 so that the elastic member 36 will be compressed while the switch 34 is forced toward the front stop portion 32*a*, and the elastic member 36 will return the switch 34 while the force is gone.

Figure 2:
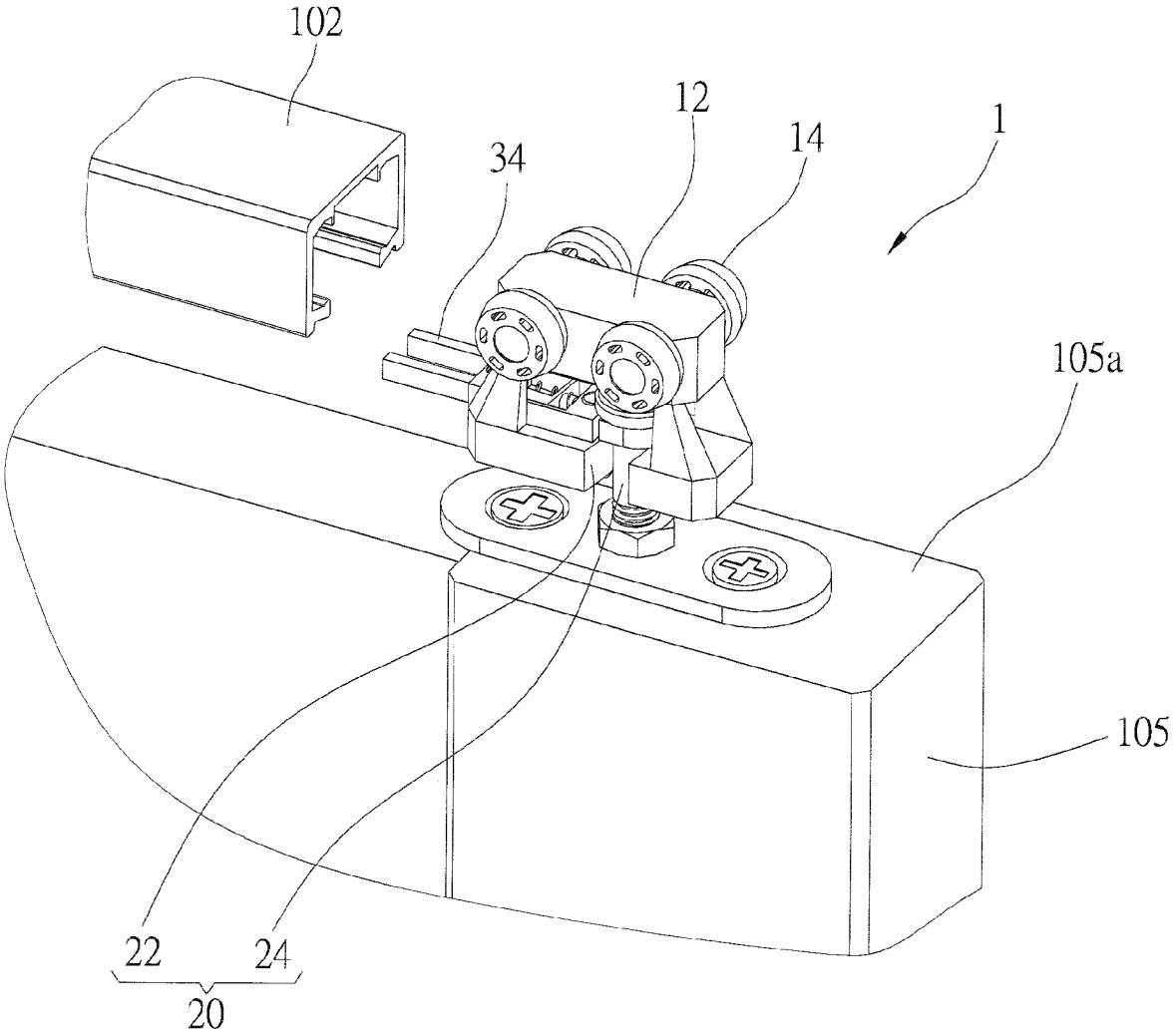
FIG. 2 is a perspective view of the first preferred embodiment of the present invention, showing the pulley assembly and the rail.
Figure 7:
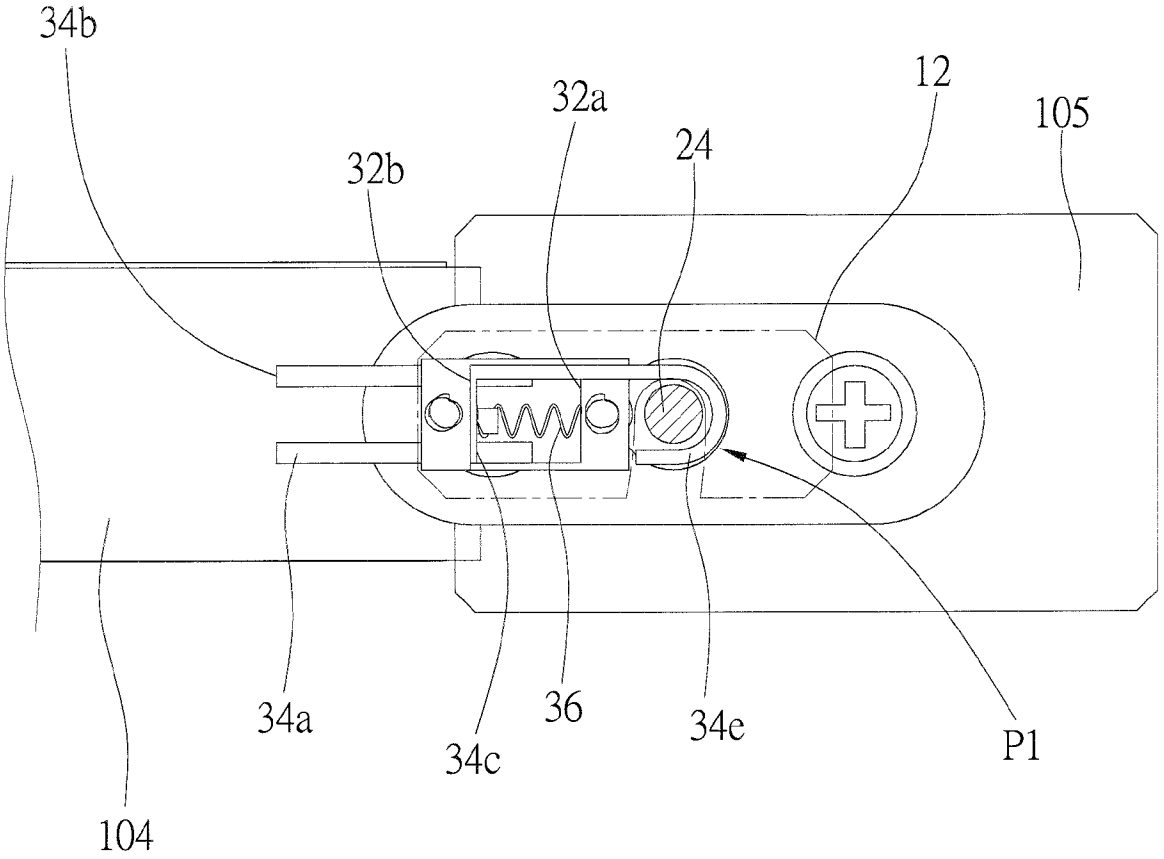
FIG. 7 is a top view of the first preferred embodiment of the present invention, showing the switch in the first position.

The solid lines in FIG. 6 show the sashes 103, 104 being expanded to close the window covering 100, in which, as shown in FIG. 2, FIG. 3, and FIG. 7, the rod 24 engages the slot 22 and is hooked by the hook 34*e* of the switch 34 to hold the rod 24 in the slot 22. We define that the switch 34 is moved to a first position P1 for above condition, and the elastic member 36 urges the switch 34 toward the first position P1.

Figure 8:
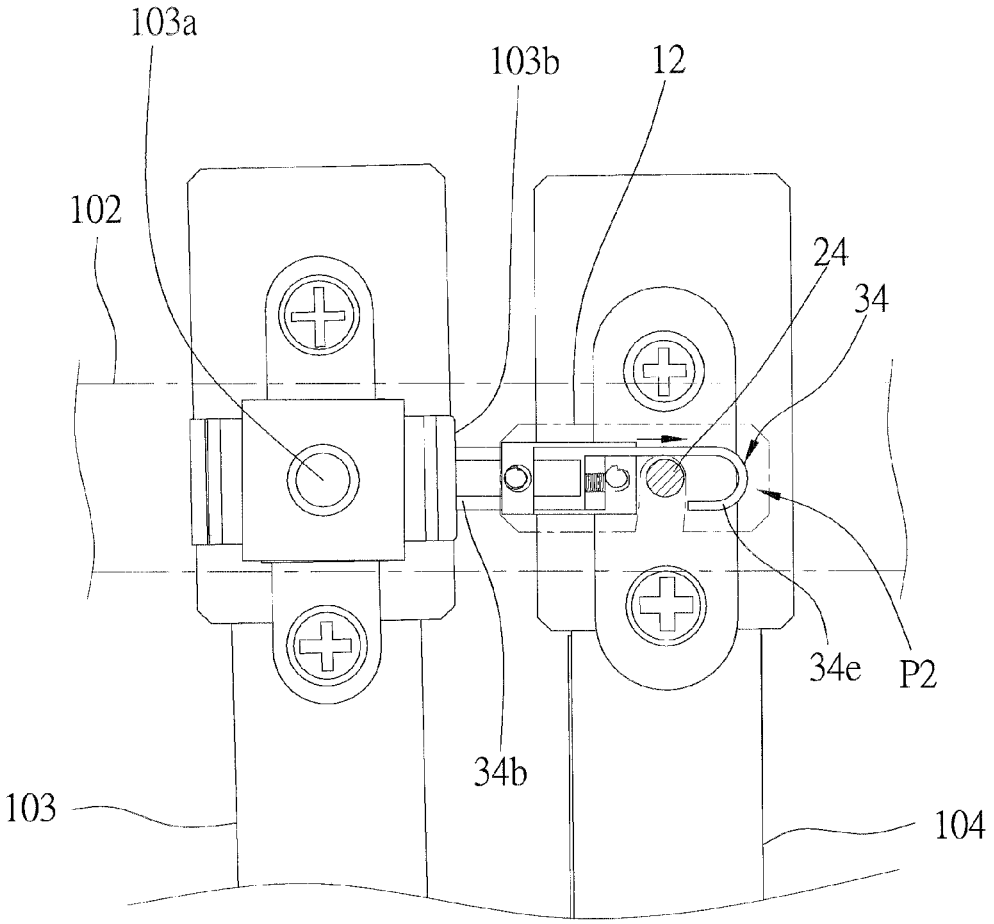
FIG. 8 is a top view of the first preferred embodiment of the present invention, showing the switch in the second position.

As shown in the dot lines of FIG. 6, when one draws the sash 104 to the left, the sashes 103, 104 rotate to fold up. In the beginning of drawing the sash 104, the hook 34*e* of the switch 34 still hooks the rod 24 to restrict the rod 24 in the slot 22. As the sash 104 keeps moving to the left, the driving portion 34*b* of the switch 34 will touch a portion 103*b* of the sash 103 eventually to move the switch 34 toward the front stop portion 32*a*. While the sashes 103, 104 are parallel, the rod 24 still is in the hook 34*e*, however, a gap of the hook 34*e* is aligned with the slot 22 (FIG. 8). We define that the switch 34 is moved to a second position P2 for above condition, and the rod 24 is able to leave the slot 22.

It is noted that the driving portions 34*b* of the switch 34 and the portion 103*b* of the sash 103 may be provided with magnets to temporarily hold the sashes 103, 104 in folded condition.

Figure 1:
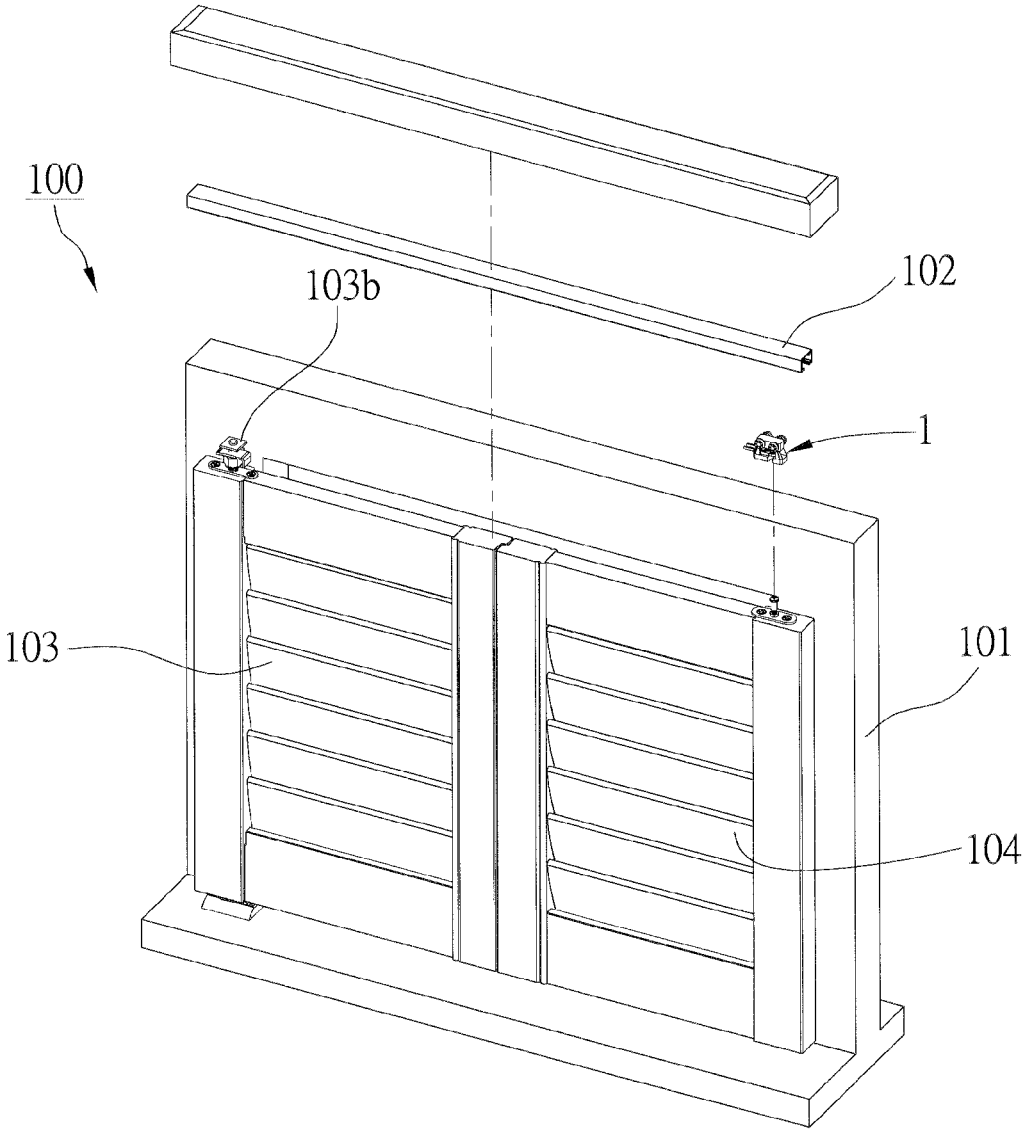
FIG. 1 is a perspective view of a first preferred embodiment of the present invention, showing the hanger incorporated in a window.
Figure 9:
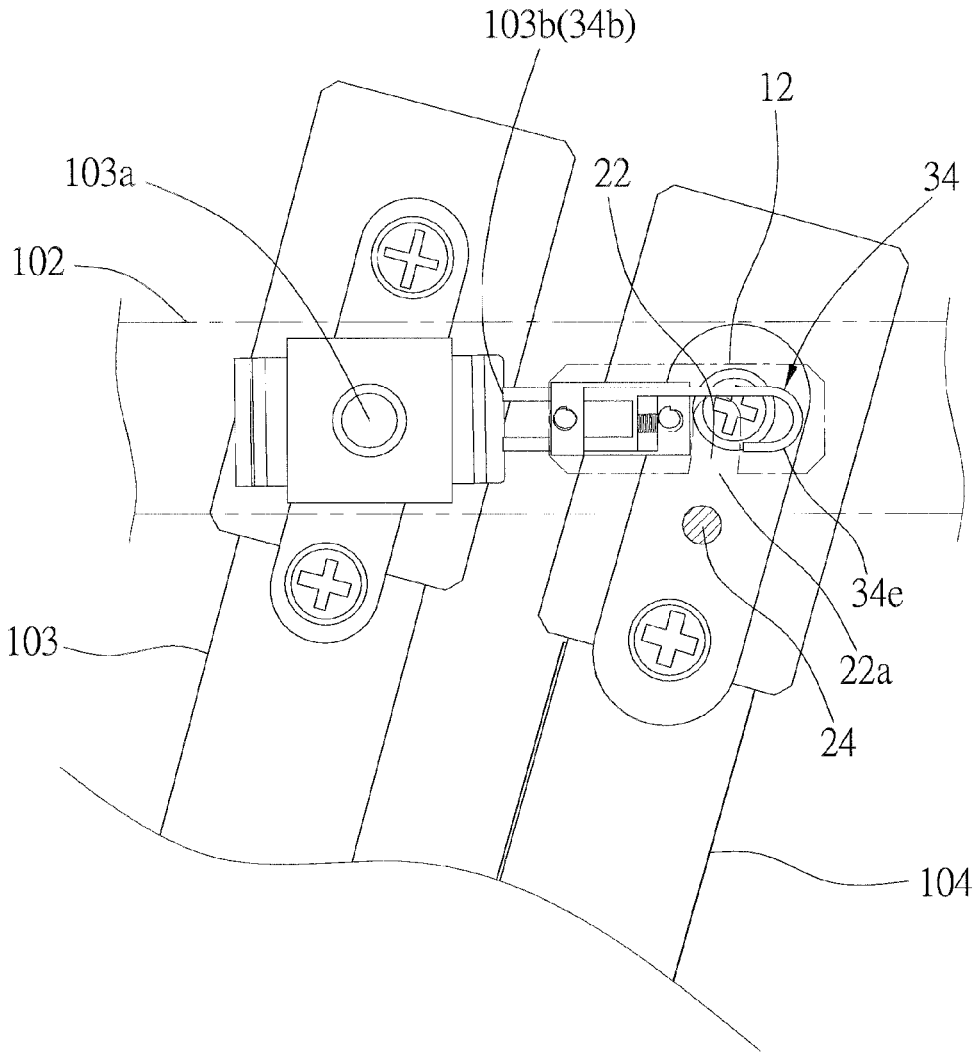
FIG. 9 is a top view of the first preferred embodiment of the present invention, showing the rod disengages the slot while rotate the folded sashes.
Figure 10:
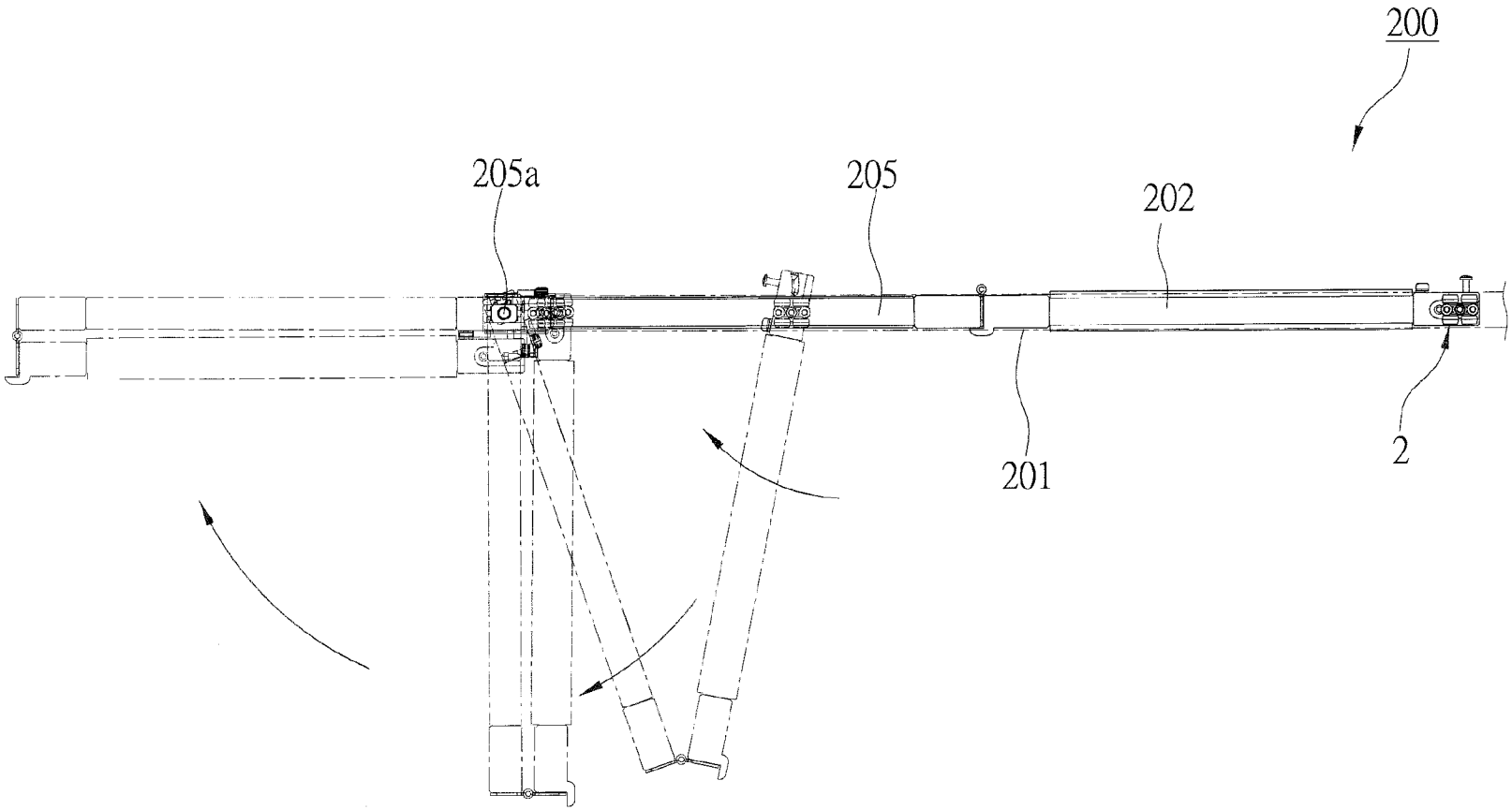
FIG. 10 is a top view of the window covering of a second preferred embodiment of the present invention, showing the movement of the sashes.
Figure 11:
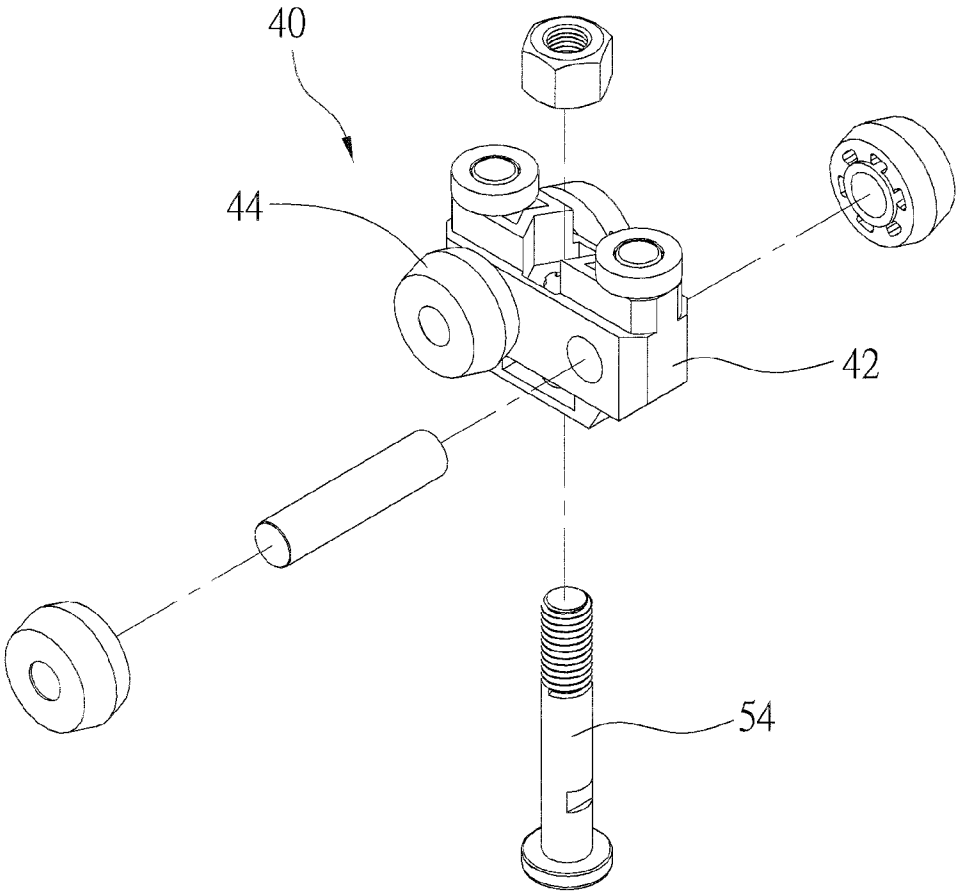
FIG. 11 is an exploded view of the second preferred embodiment of the present invention.
Figure 12:
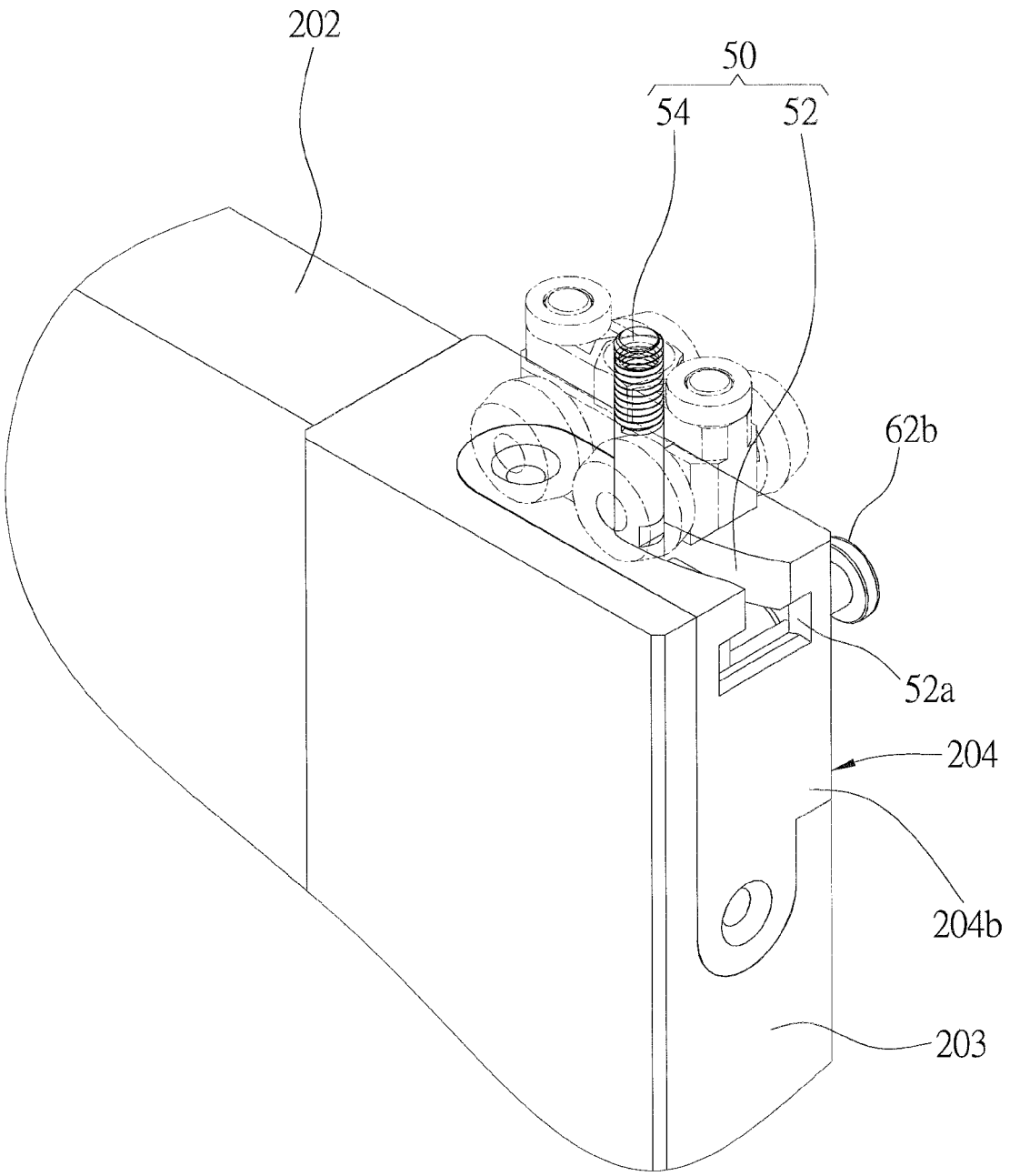
FIG. 12 is a perspective view of the second preferred embodiment of the present invention, showing the pulley assembly on the sash.
Figure 13:
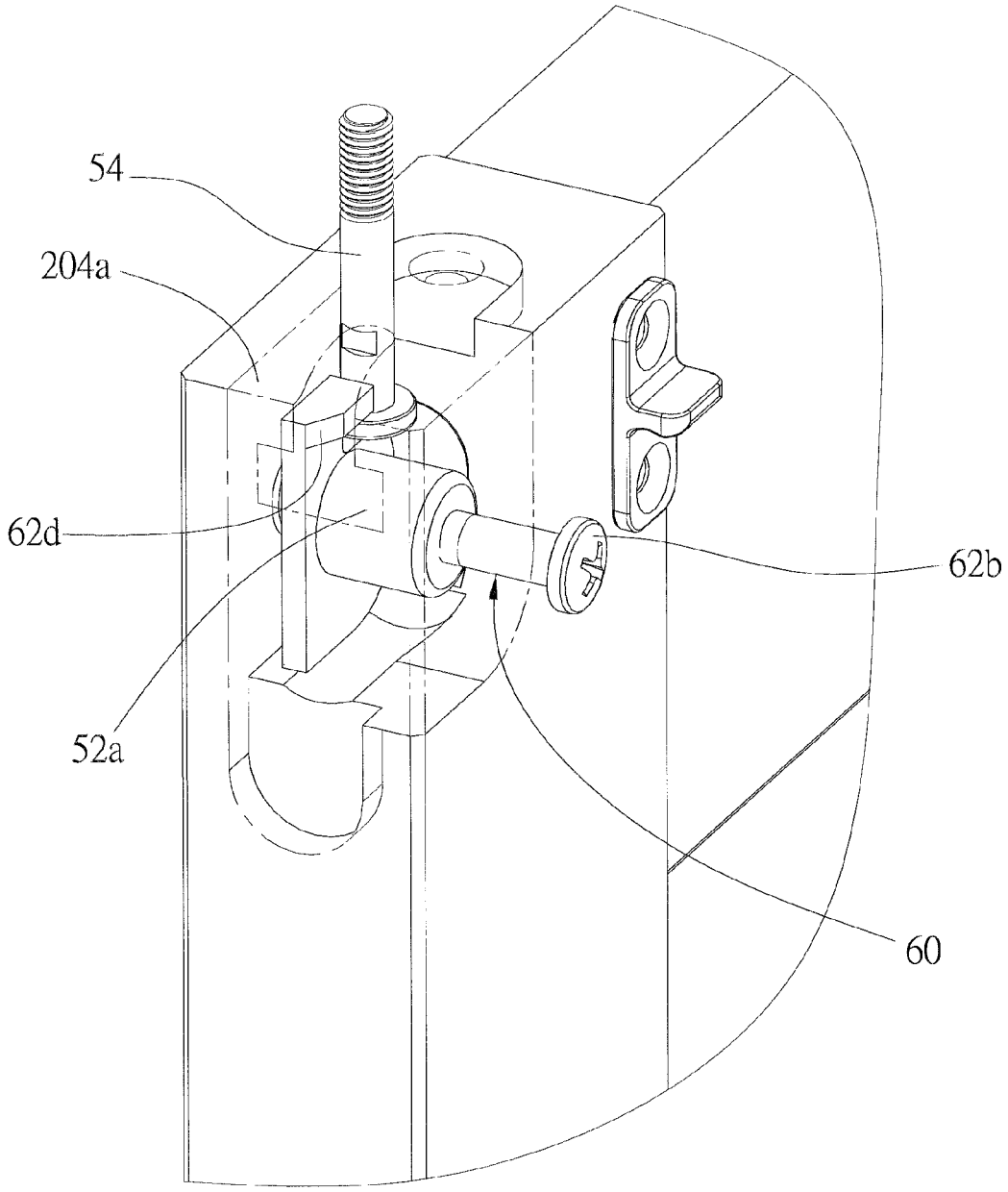
FIG. 13 is another perspective view of the second preferred embodiment of the present invention, showing the pulley assembly on the sash.

Next, when one rotates the folded sashes 103, 104 to the left (FIG. 9), the rod 24 will move off the slot 22 through the end opening 22*a* to disengage the hanger 10 with the rail 102. As a result, the sash 104 is free to be moved off the rail 102, and the sashes 103, 104 may be moved onto a wall beside the window. On the contrary, the sashes 103, 104 may be moved back from the wall to re-engage the sash 104 with the rail 102 in a reverse way, and that will make the sashes 103, 104 to move in the rail 102 again, and finally move the sashes 103, 104 back to close the window covering 100 as shown in FIG. 1.

Instead of an arched rail, the present invention provides the detachable hanger 1 on a straight rail 102. It has the same function as the arched rail to move the sashes totally off the window, but still keeps a straight movement while the sashes are still in the rail 102.

FIGS. from FIG. 10 to FIG. 13 show a detachable hanger 2 of the second preferred embodiment, which is incorporated in a window 200 with two sashes 202, 205. The hanger 2 includes a pulley assembly 40, an engaging assembly 50, and a restricting assembly 60.

The pulley assembly 40 has a base 42 and a plurality of pulleys 44 mounted on the base 42 for free rotation. The pulleys 44 engage a rail 201 on the window covering 200 so that the base 42 is able to move in the rail 201.

Figure 14:
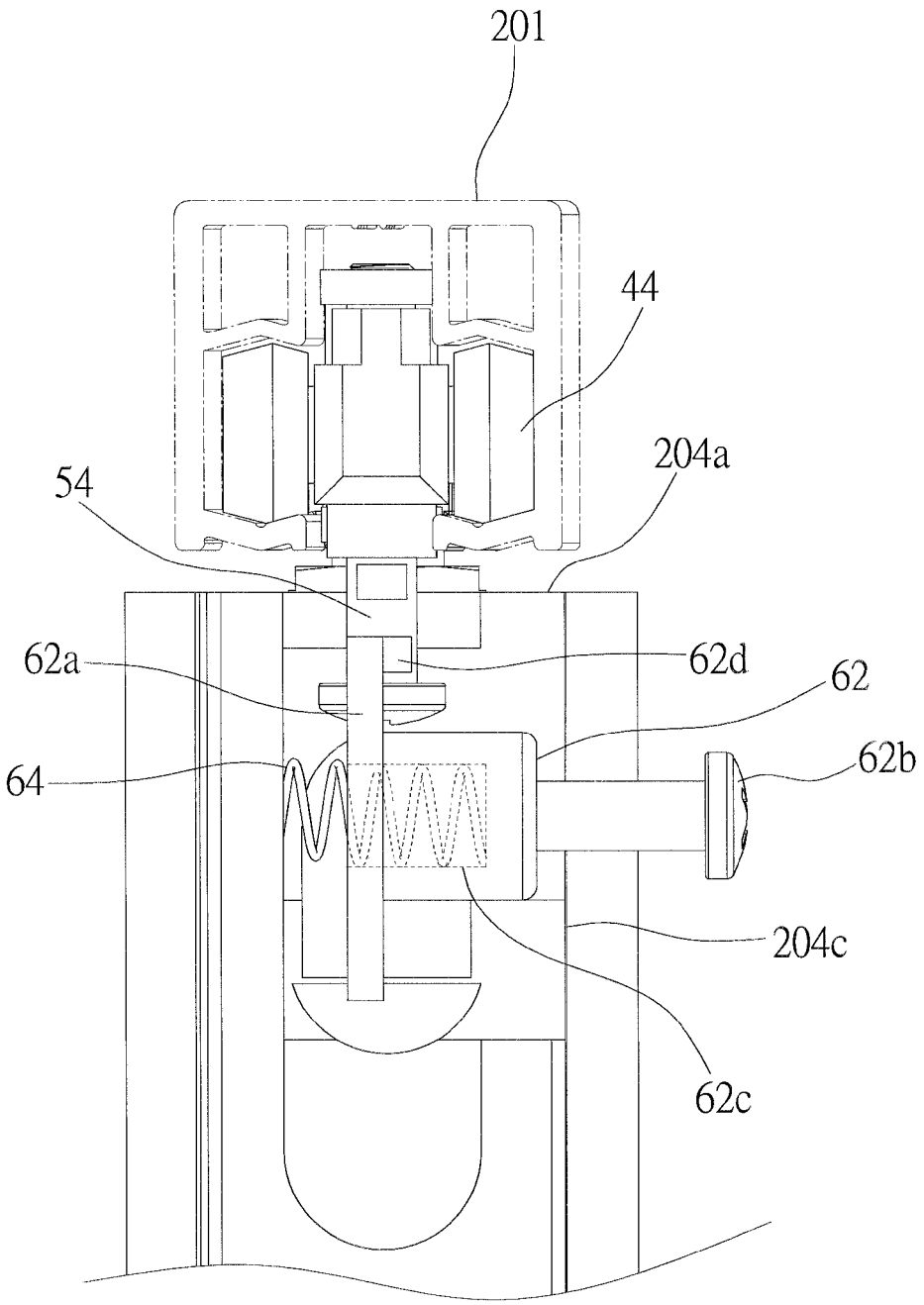
FIG. 14 is a side view of the second preferred embodiment of the present invention.

The engaging assembly 50 has a slot 52 and a rod 54. The slot 52 is provided on a sash frame 203 of the sash 202. In an embodiment, the sash frame 203 is provided with a recess at a corner thereof, and a lid 204 is fixed to the sash frame 203 to cover the recess. The lid 204 has a top portion 204*a* and a lateral portion 204*b* on a top edge and a lateral edge of the sash frame 203. The lid 204 further has a side portion 204*c*, which is vertical to both the top portion 204*a* and the lateral portion 204*b*, on a front side of the sash frame 203. The slot 52 is a curved slot extending on the top portion 204*a* of the lid 204. The slot 52 extends to the lateral portion 204*b* to form an end opening 52*a* thereon. The rod 54 has an end fixed to the base 42 and an opposite end engaging the slot 52, as shown in FIG. 14. In an embodiment, the rod 54 is a bolt screwed into a thread hole of the base 42. The rod 54 has a head bigger than a width of the slot 52 on the top portion 204*a*, and the end opening 52*a* is bigger than the diameter of the rod 54, so that the rod 54 will move in the slot 52 and leave the slot 52 via the opening 52*a* only.

The restricting assembly 60 has a switch 62 and an elastic member 64, both of which are provided in recess of the sash frame 203 of the sash 202 and is under the lid 204. The switch 62 has a stop portion 62*a* and a driving portion 62*b* on opposite sides. The driving portion 62*b* extends out of the sash frame 203 via the side portion 204*c*. The switch 62 further has a bore 62*c* and an inclined face 62*d* on the stop portion 62*a*. The inclined face 62*d* faces the opening 52*a*. The elastic member 64, which can be a compression spring as well, has an end urging an inner side of the sash frame 203 and an opposite end entering the bore 62*c* to urge the switch 62 outwardly.

Similar to the first preferred embodiment, when the sashes 202, 205 expand to close the window covering 200, the rod 54 is restricted by the stop portion 62*a* of the switch 62 and stays in the slot 52. We define it that the switch 62 is in a first position.

Figure 15:
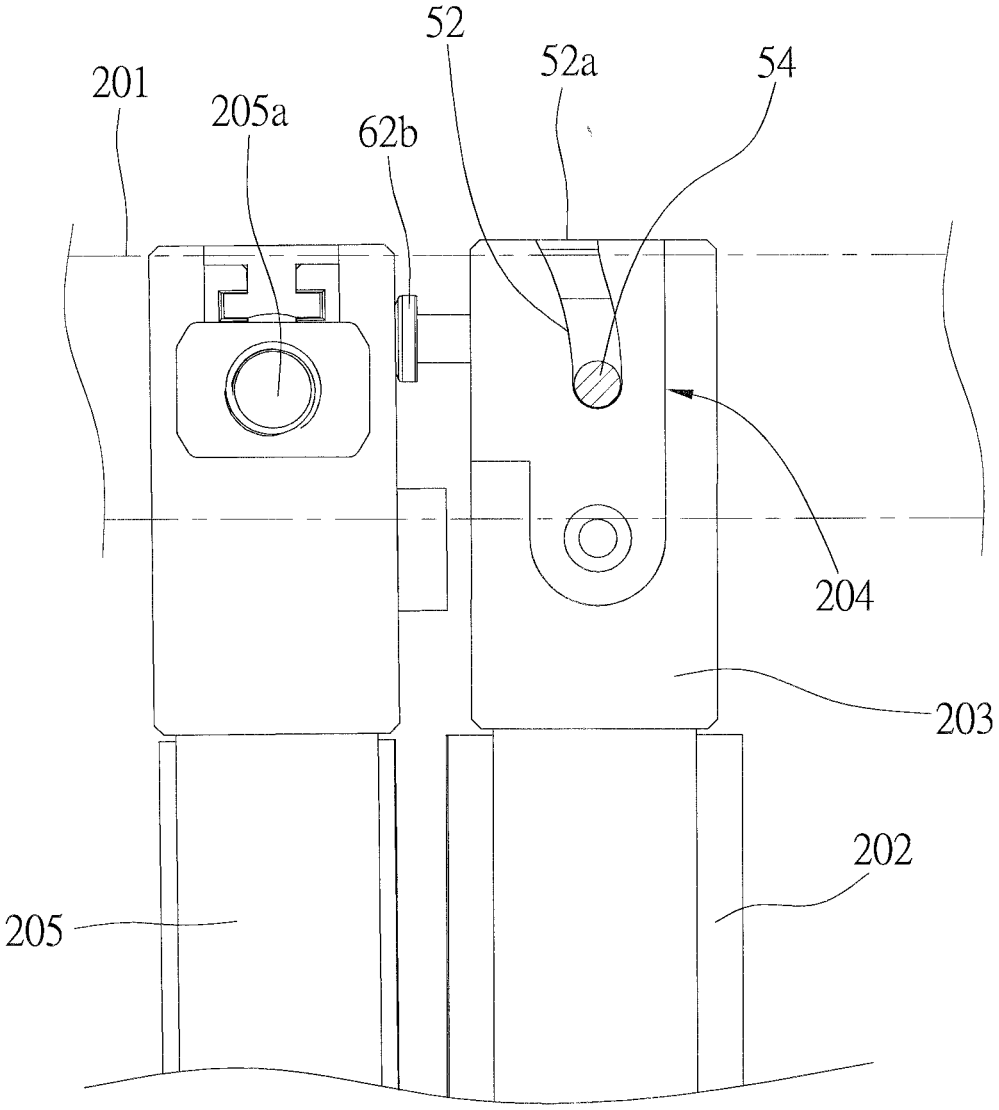
FIG. 15 is a top view of the second preferred embodiment of the present invention, showing the driving portion of the switch touches the other sash while the sashes are parallel and vertical to the rail.

While one moves the sash 202 toward the sash 205, the hinged sashes 202, 205 rotate, and the driving portion 62*b* of the switch 62 will touch sash 205 while the sashes 202, 205 are parallel and vertical to the rail 201. At this time, the switch 62 will be moved to a second position, in which the elastic member 64 is compressed, and the stop portion 62*a* leaves the slot 52 open to free the rod 54, as shown in FIG. 15 and FIG. 16.

Figure 17:
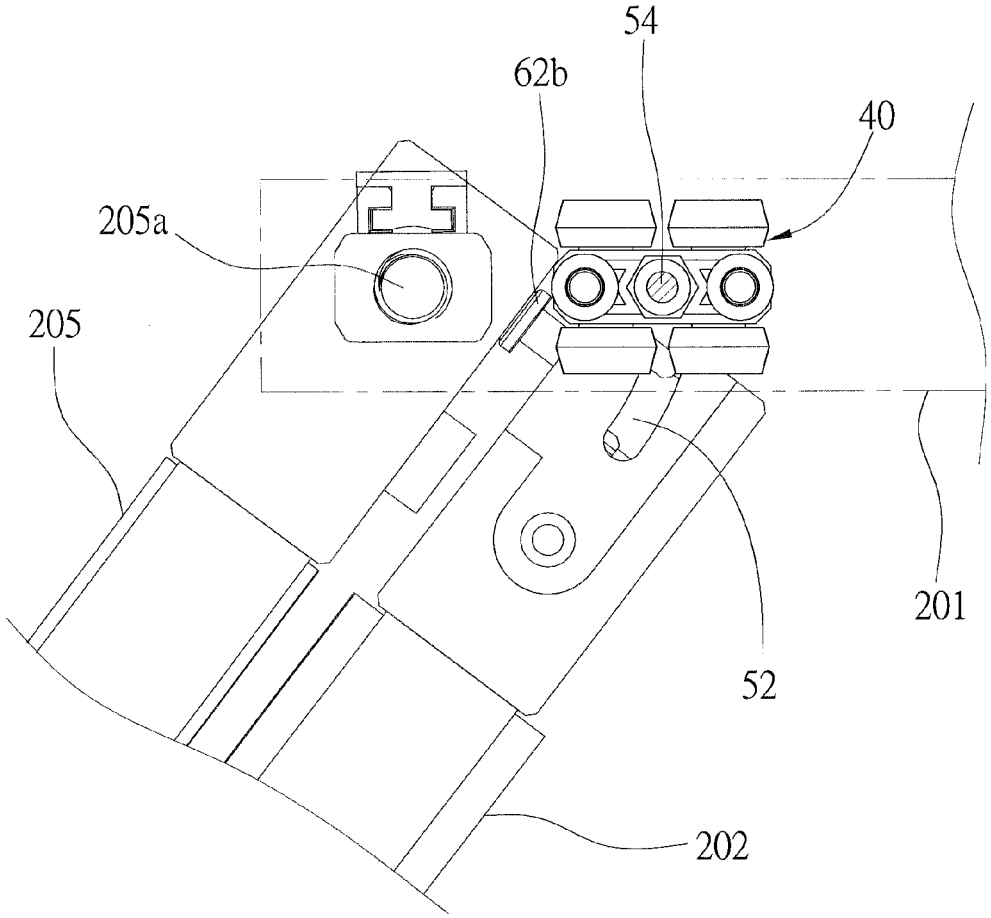
FIG. 17 is a top view of the second preferred embodiment of the present invention, showing the rod disengages the slot while rotate the folded sashes.

Next, one moves the sashes 202, 205 to make them rotate along a pin 205*a*. At this time, the rod 54 will leave the slot 52 via the opening 52*a* to disengage the hanger 2 with the sash 202 (FIG. 17). One may move the sashes 202, 205 totally off the window opening and attach them to a wall beside the window opening.

On the contrary, the sashes 202, 205 may be moved back in a reverse way to make the rod 54 enter the slot 52 via the opening 52*a* that may reengage the sash 202 with the rail 201 again. As a result, the sashes 202, 205 may move in the rail 201 to close the window covering 200.

Figure 16:
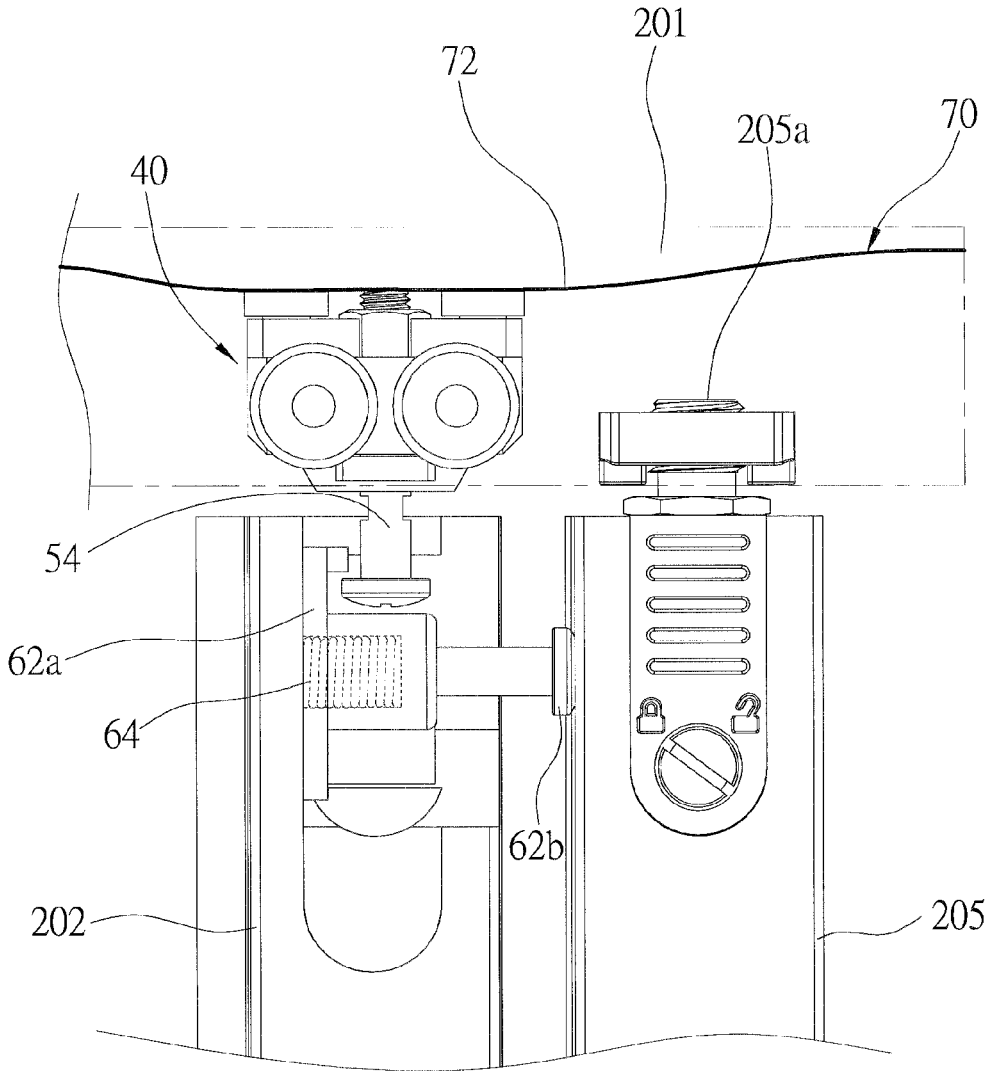
FIG. 16 is a side view of the second preferred embodiment of the present invention, showing the switch in the second position.

As shown in FIG. 16, a biasing member 70 is provided in the rail 201. The biasing member 70 is a flexible elongated plate having a flexible portion 72 at a center thereof. While the sash 202 is moved to a position where the sash 202 is about to be disengaged with the rail, the pulley assembly 40 is right under the biasing member 70 and the biasing member 70 presses the pulley assembly 40 onto the rail 201. As a result, the pulley assembly 40 will be temporarily held right there to wait for the sash 205. The biasing member 70 may be incorporated in the rail 102 of the first preferred embodiment in the same way.

FIG. 18 to FIG. 25 show a covering of a building opening of the third preferred embodiment of the present invention, and in the opening is a window 100, and the covering is a window covering for example. The window 100 has a window frame 101. The window covering has a rail 80, a first sash 82, a second sash 84, a locking base 86, a pulley assembly 88, and a restricting assembly 90. The combination of the pulley assembly 88 and the restricting assembly 90 is a detachable hanger.

Figure 27:
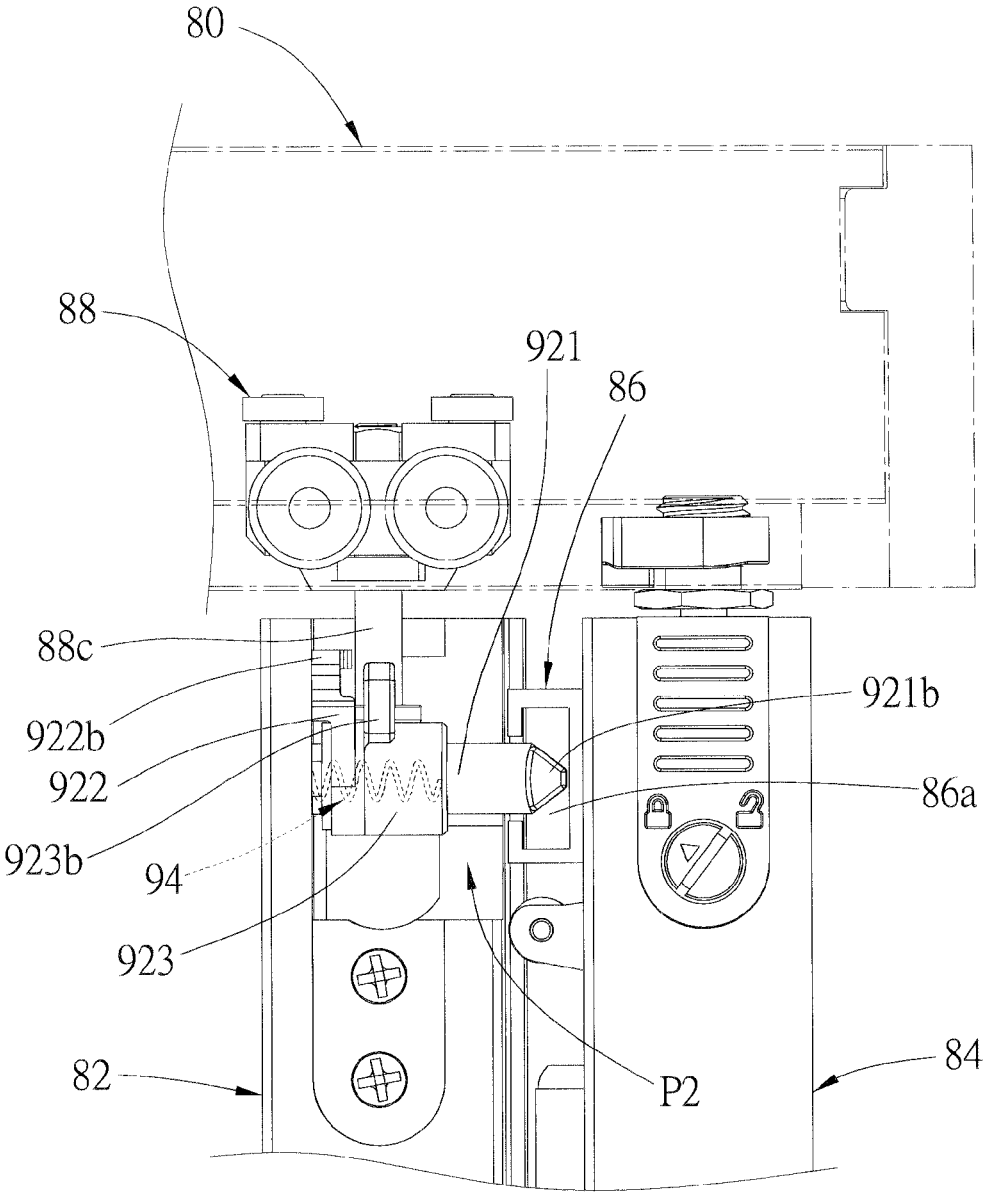
FIG. 27 is a lateral view of the third preferred embodiment of the present invention, showing the movable unit at the second position.

The rail 80 is mounted on a top edge of the window frame 101. The first and the second sashes 82, 84 are hinged together by two hinges 83, and the second sash 84 is pivoted on the rail 80 through a pin 85, therefore the first and the second sashes 82, 84 are extended to close the opening of the building (FIG. 18), folded and moved to an end of the rail 80 (FIG. 20), and moved outwardly to be attached to a wall W beside the opening (FIG. 21). The locking base 86 is connected to the second sash 84. As shown in FIG. 27, the locking base 86 has a slot 86*a*.

Figure 22:
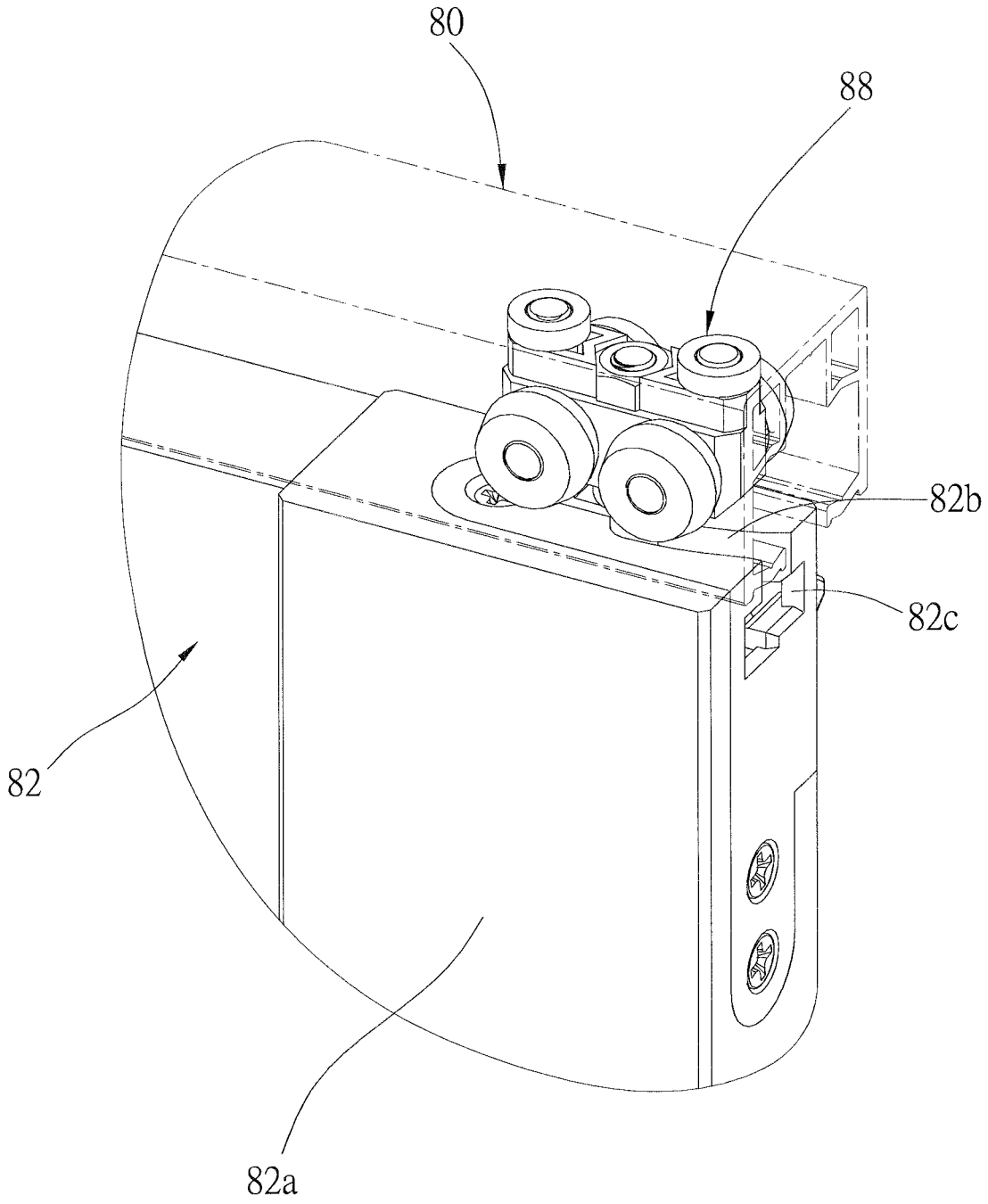
FIG. 22 is a perspective view of the third preferred embodiment of the present invention, showing the pulley assembly and the rail.
Figure 23:
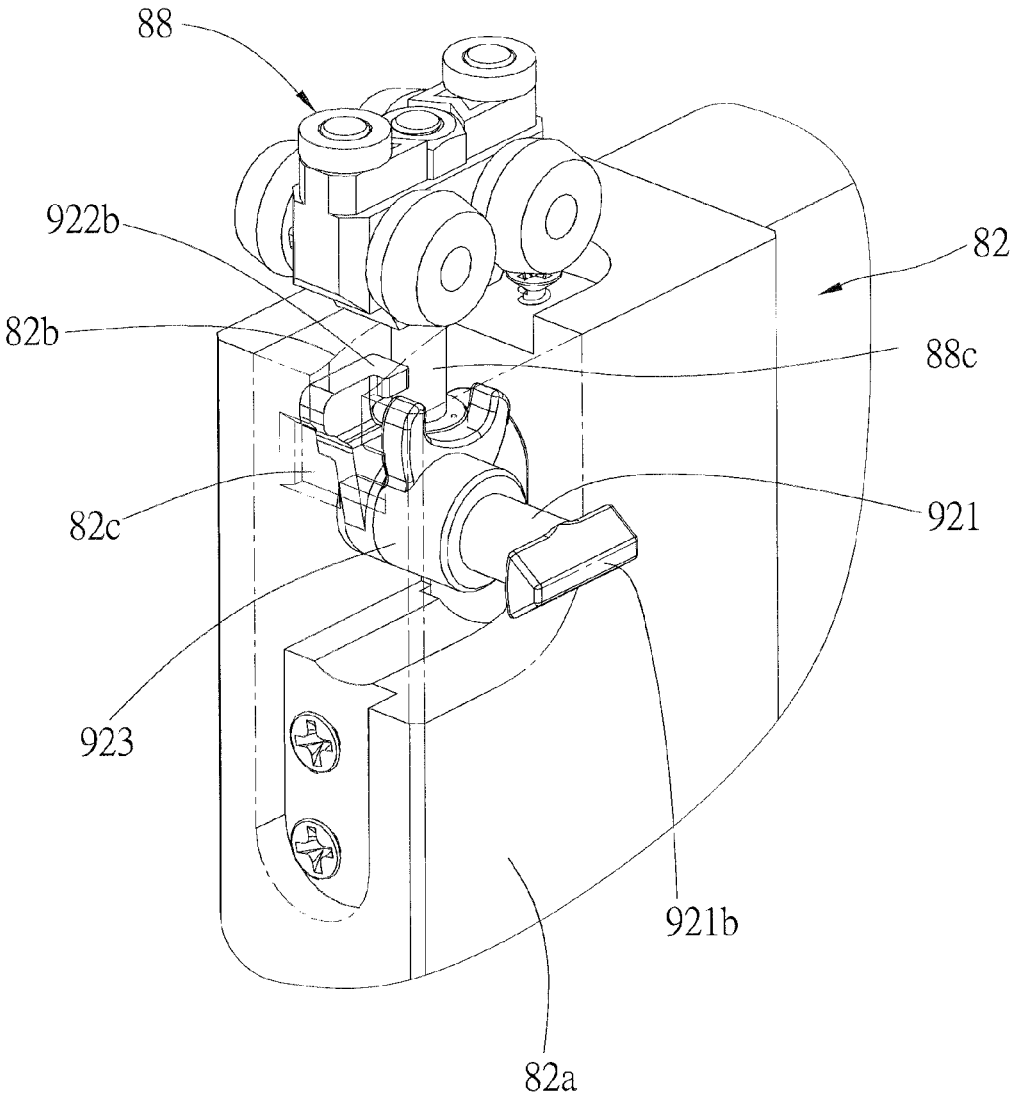
FIG. 23 is a perspective view of the third preferred embodiment of the present invention, showing the pulley assembly and the restricting assembly.

As shown in FIG. 22 and FIG. 23, the first sash 82 has a sash frame 82*a*, and the sash frame 82*a* is provided with a guiding slot 82*b* on a top thereof. The guiding slot 82*b* is curved and has an end opening 82*c* at a vertical side of the sash frame 82*a*. The guiding slot 82*b* is a part of the detachable hanger as well.

Figure 24:
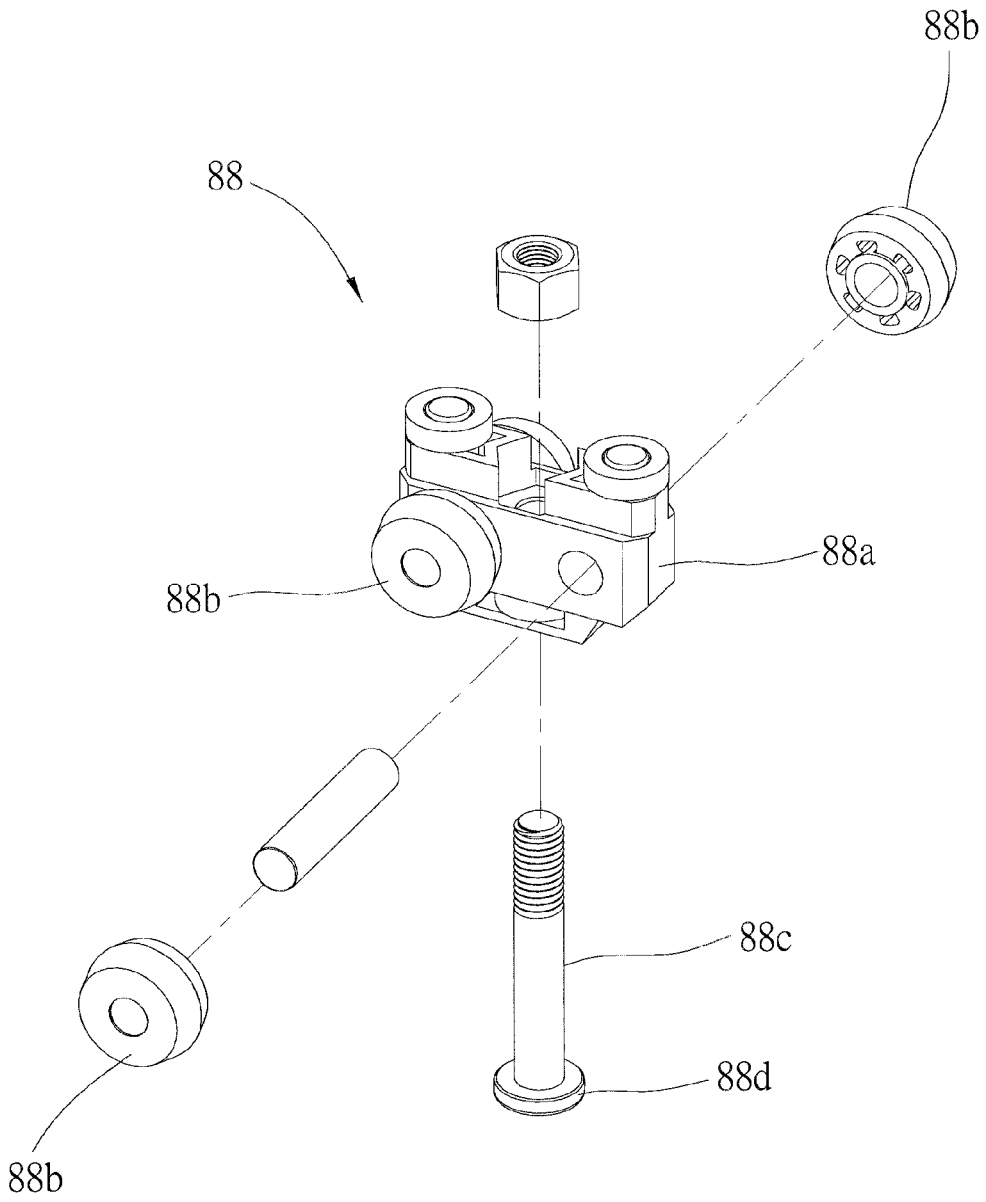
FIG. 24 is an exploded view of the pulley assembly of the third preferred embodiment of the present invention, showing the components of the pulley assembly.

The pulley assembly 88 engages the rail 80 to move along the rail 80. As shown in FIG. 24, the pulley assembly 88 has a base 88*a*, a plurality of pulleys 88*b* mounted on the base 88*a* for free rotation, and a rod 88*c*. The pulleys 88*b* touch a sidewall of the rail 80. The rod 88*c* is projected from a bottom of the base 88*a*. The rod 88*c* has a protrusion section 88*d* extending out of the rail 80. The protrusion section 88*d* of the rod 88*c* enters and leaves the guiding slot 82*b* of the sash frame 82*a* via the end opening 82*c* while the pulley assembly 88 is moving.

Figure 25:
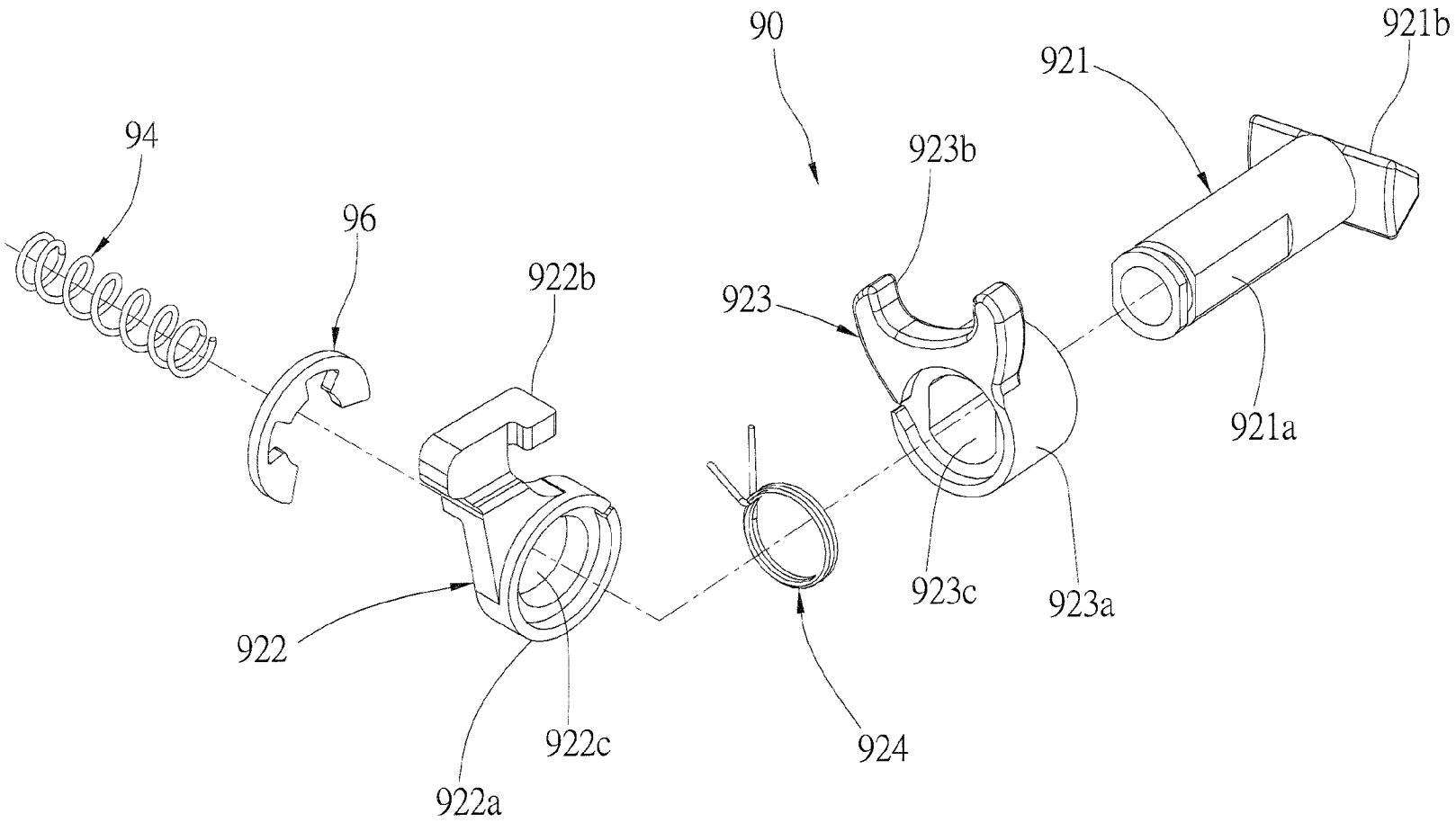
FIG. 25 is an exploded view of the restricting assembly of the third preferred embodiment of the present invention, showing the components of the restricting assembly.
Figure 26:
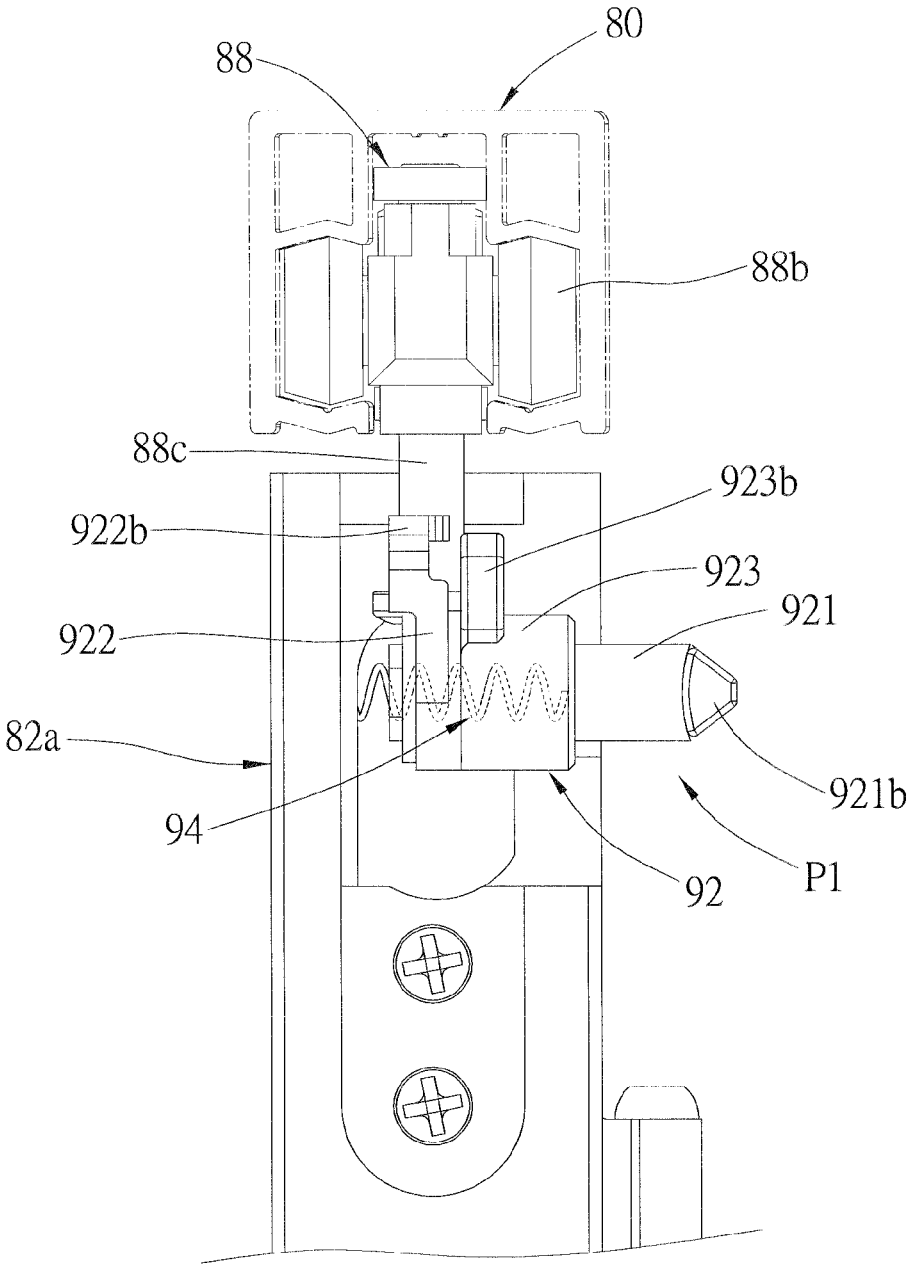
FIG. 26 is a lateral view of the third preferred embodiment of the present invention, showing the movable unit at the first position.

The restricting assembly 90 is embedded in the sash frame 82*a*. As shown in FIG. 25 and FIG. 26, the restricting assembly 90 has a movable unit 92 and a pushing member 94. The movable unit 92 is moved between a first position P1 (FIG. 26) and a second position P2 (FIG. 27).

The movable unit 92 has a tube 921, a stop member 922, a moving member 923 and a torsion spring 924. The tube 921 has an engaging section 921*a*, which has a cross section, and a shape of the cross section is not round. The tube 921 further has a contacting portion at an end thereof, and the contacting portion extends out of the sash frame 82*a*. In an embodiment, the contacting portion is a T-shaped connector 921*b*. The stop member 922 has a ring 922*a* and a block 922*b*. The ring 922*a* has a round hole 922*c* at a center, and the tube 921 is inserted into the round hole 922*c*. Therefore, the block 922*b* is connected to the tube 921, and is able to rotate related to the tube 921. In an embodiment, the ring 922*a* and the block 922*b* are made into a single unit.

The moving member 923 of the movable unit 92 is provided on the tube 921, and is able to rotate around an axis of the tube 921 along with the tube 921. The moving member 923 rotates between a third position P3 (FIG. 28) and a fourth position P4 (FIG. 29). In an embodiment, the moving member 923 has a pipe 923*a* and a pincer-like guiding portion 923*b* on the pipe 923*a*. The pipe 923*a* has an engaging hole 923*c*, which is complementary to the engaging section 921*a*. When the engaging section 921*a* is engaged with the engaging hole 923*c*, the tube 921 is connected to the moving member 923 and rotates together. The torsion spring 924 is fitted to the tube 921 to urge the stop member 922 and the moving member 923 respectively. The stop member 922 is restricted in the sash frame 82*a* of the first sash 82, so that it does not move while the tube 921 is rotating, and the torsion spring 924 urges the moving member 923 toward the fourth position P4.

After the moving member 923, the torsion spring 924, and the stop member 922 are fitted to the tube 921 in sequence, a locking ring 96 is engaged with an end of the engaging section 921*a* to secure those elements on the tube 921. In an embodiment, the pushing member 94 is a spring, which has opposite ends urging the sash frame 82*a* and an inner wall of the tube 921 respectively to urge the movable unit 92 toward the first position P1.

Figure 18:
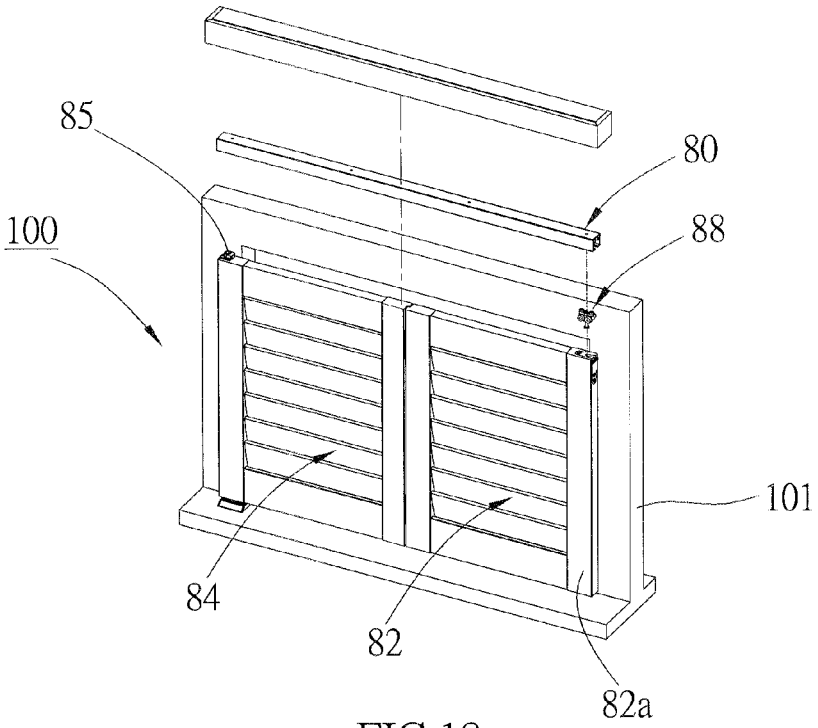
FIG. 18 and FIG. 19 are perspective views of a third preferred embodiment of the present invention, showing the sashes closing the opening.
Figure 19:
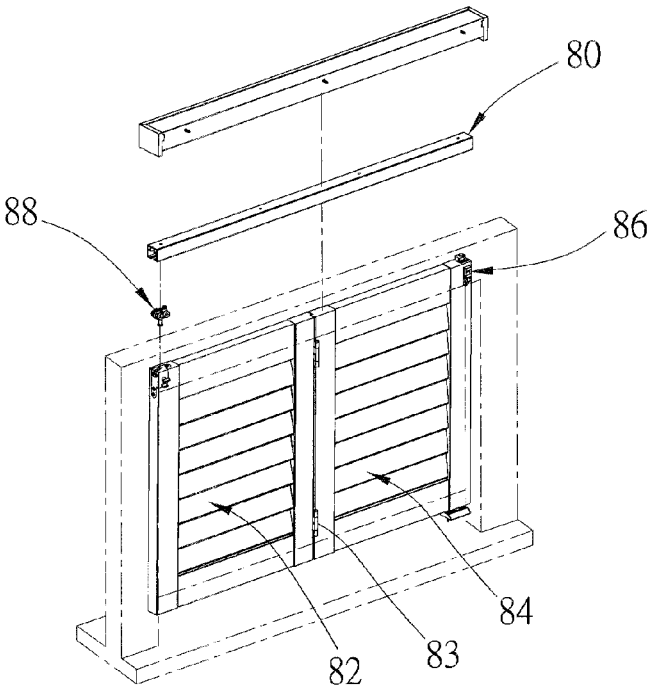

FIG. 18 shows that the sashes 82, 84 are extended to close the opening, in which the movable unit 92 is moved by the pushing member 94 and kept at the first position P1, and the block 922*b* of the stop member 922 is on a moving path of the rod 88*c* of the pulley assembly 88 (FIG. 26), so that while the first sash 82 is being moved toward the second sash 84, the rod 88*c* is stopped by the block 922*b*. In other words, the end opening 82*c* of the guiding slot 82*b* is closed, and the rod 88*c* is restricted in the guiding slot 82*b* before the sashes 82, 84 are folded.

Figure 20:
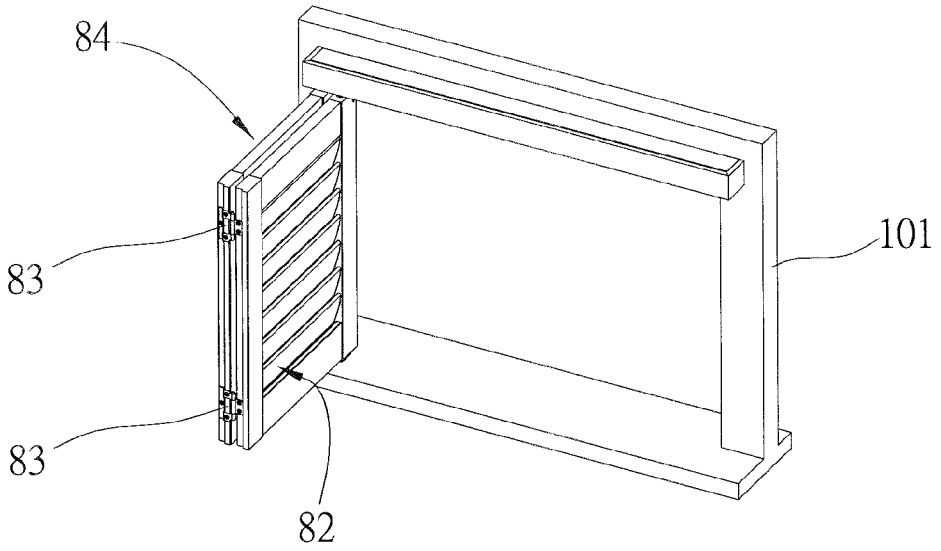
FIG. 20 is a perspective view of the third preferred embodiment of the present invention, showing the sashes folded and perpendicular to the rail.
Figure 21:
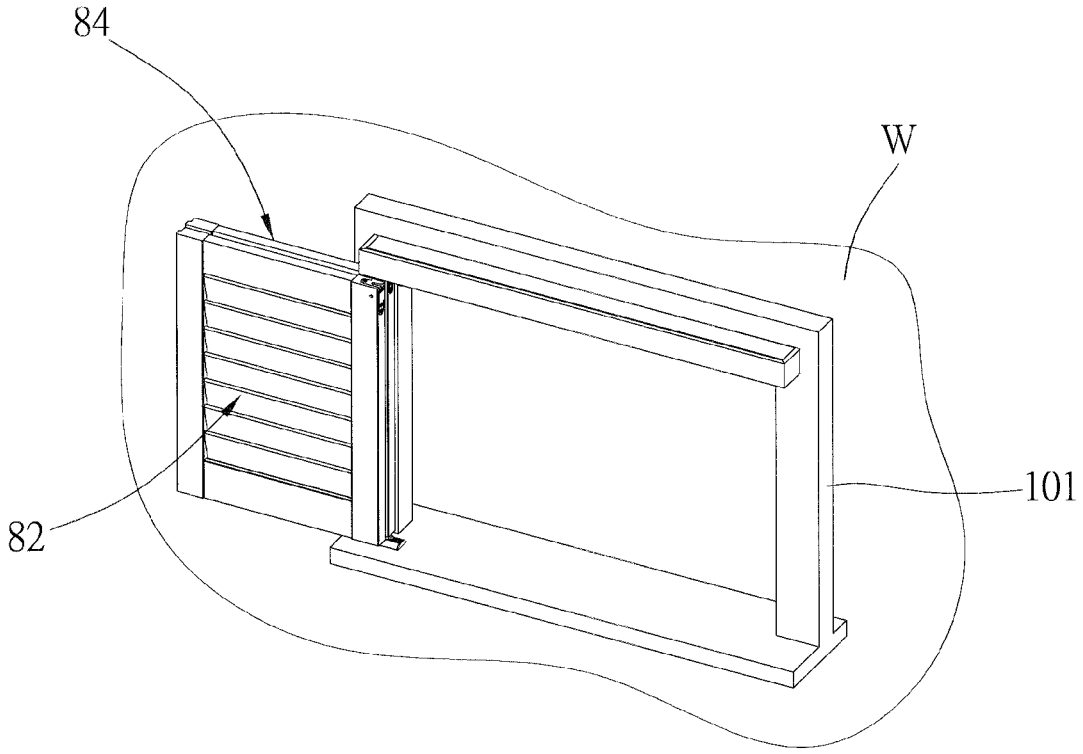
FIG. 21 is a perspective view of the third preferred embodiment of the present invention, showing the sashes away from the opening and attached to the wall.
Figure 28:
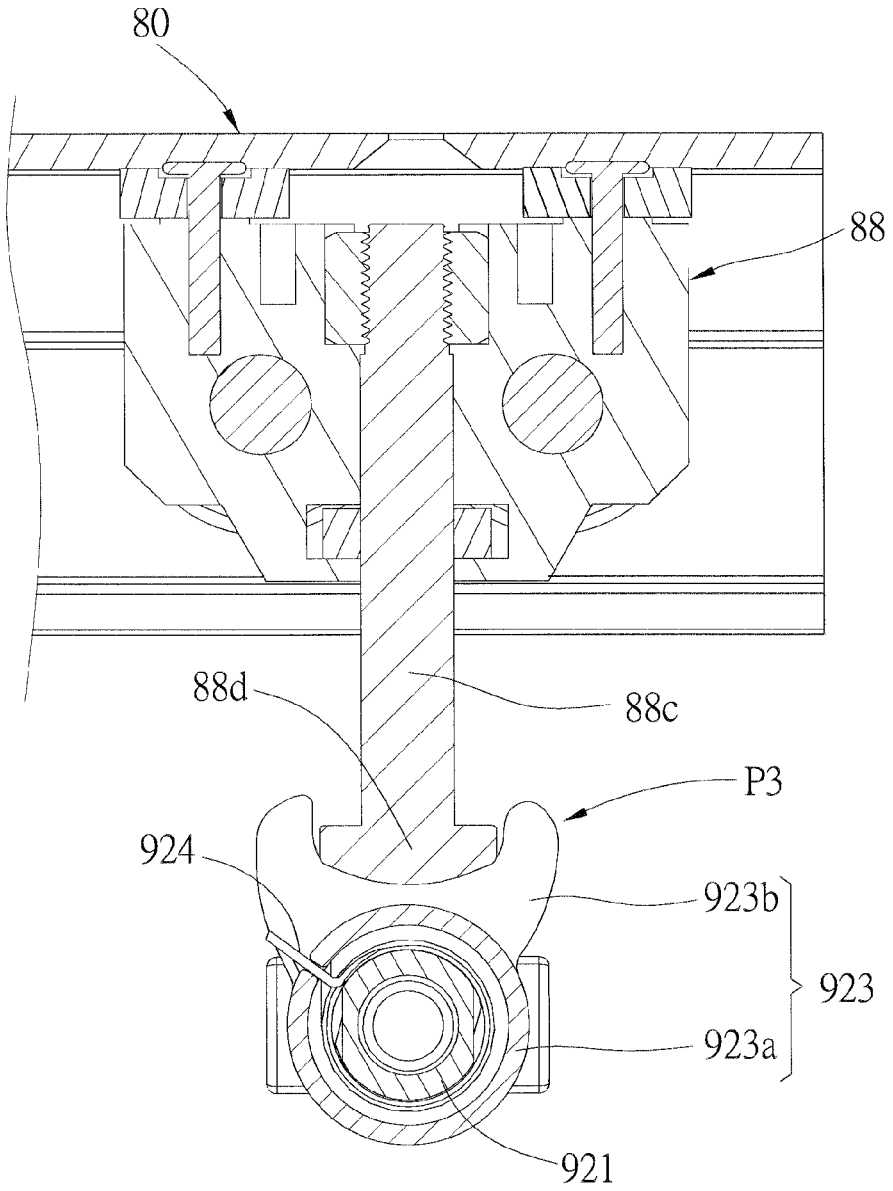
FIG. 28 is a lateral view of the third preferred embodiment of the present invention, showing the moving member at the third position.
Figure 29:
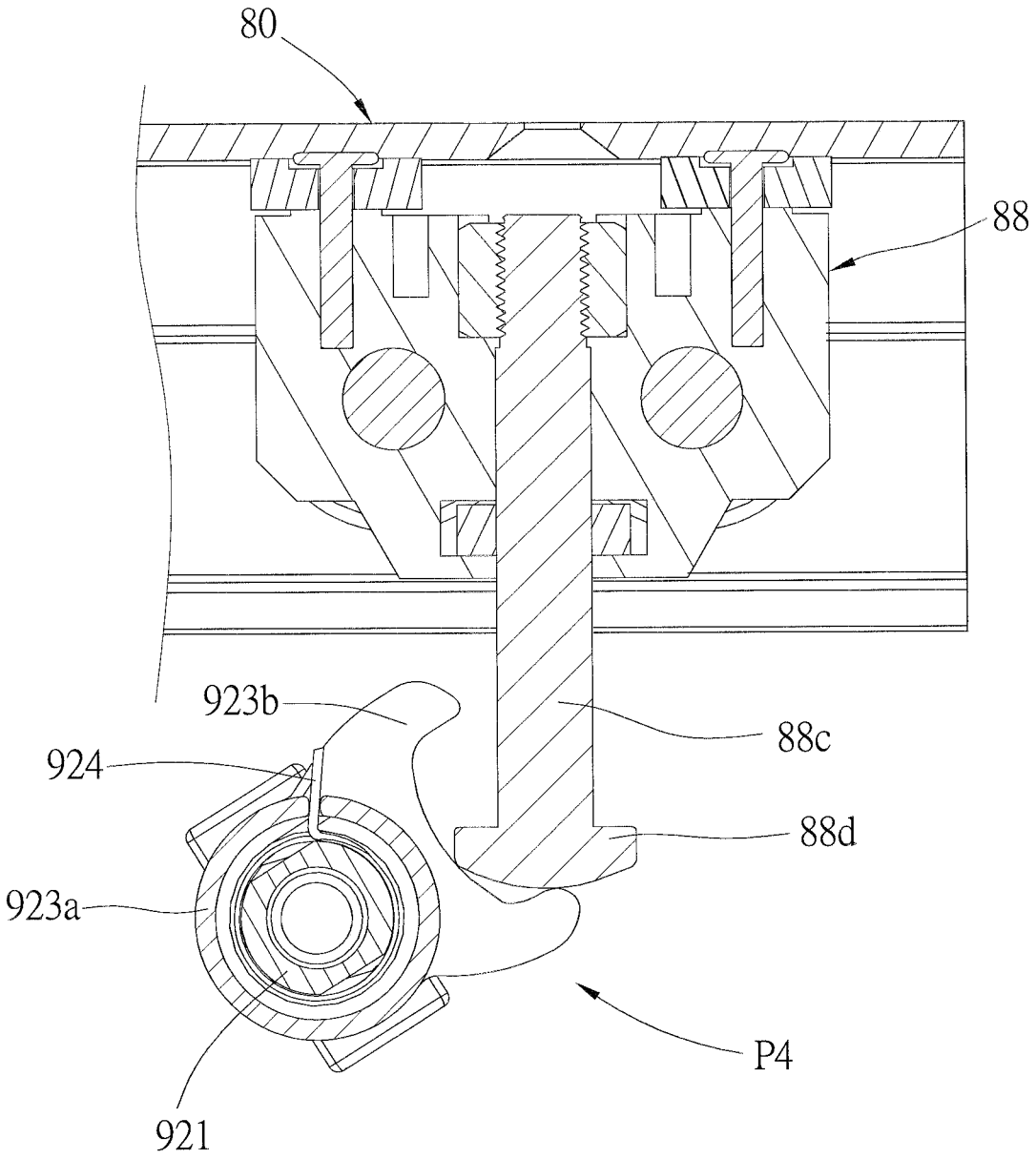
FIG. 29 is a lateral view of the third preferred embodiment of the present invention, showing the moving member at the fourth position.

As shown in FIGS. 20, 27, and 28, while the first sash 82 is being moved toward the second sash 84, the first sash 82 is moving and turning, and the second sash 84 is turned along with the first sash 82 until the first and the second sashes 82, 84 are folded and substantially perpendicular to the rail 80. At this moment, the moving member 923 is kept at the third position P3, and the connector 921*b* of the tube 92 presses the slot 86*a* of the locking base 86, and with the counterforce the movable unit 92 is moved to the second position P2. When the movable unit 92 is moved to the second position P2, the block 922*b* moves away to free the rod 88*c*, and the rod 88*c* is rested on the guiding portion 923*b* of the moving member 923. Precisely, the guiding portion 923*b* has two hill portions and a cavity between the hill portions, and the rod 88*c* is rested on a bottom of the cavity.

Next, the user may keep moving the folded sashes 82, 84 outwards to the wall W (FIG. 21). In the beginning, the rod 88*c* touches the right hill portion of guiding portion 923*b* to turn the moving member 923, with the assistant of the torsion spring 924, toward the fourth position P4 (FIG. 29), and the rod 88*c* is free to leave the guiding slot 82*b* via the end opening 82*c*, so the sashes 82, 84 are able to move continuously toward the wall W.

Figure 30:
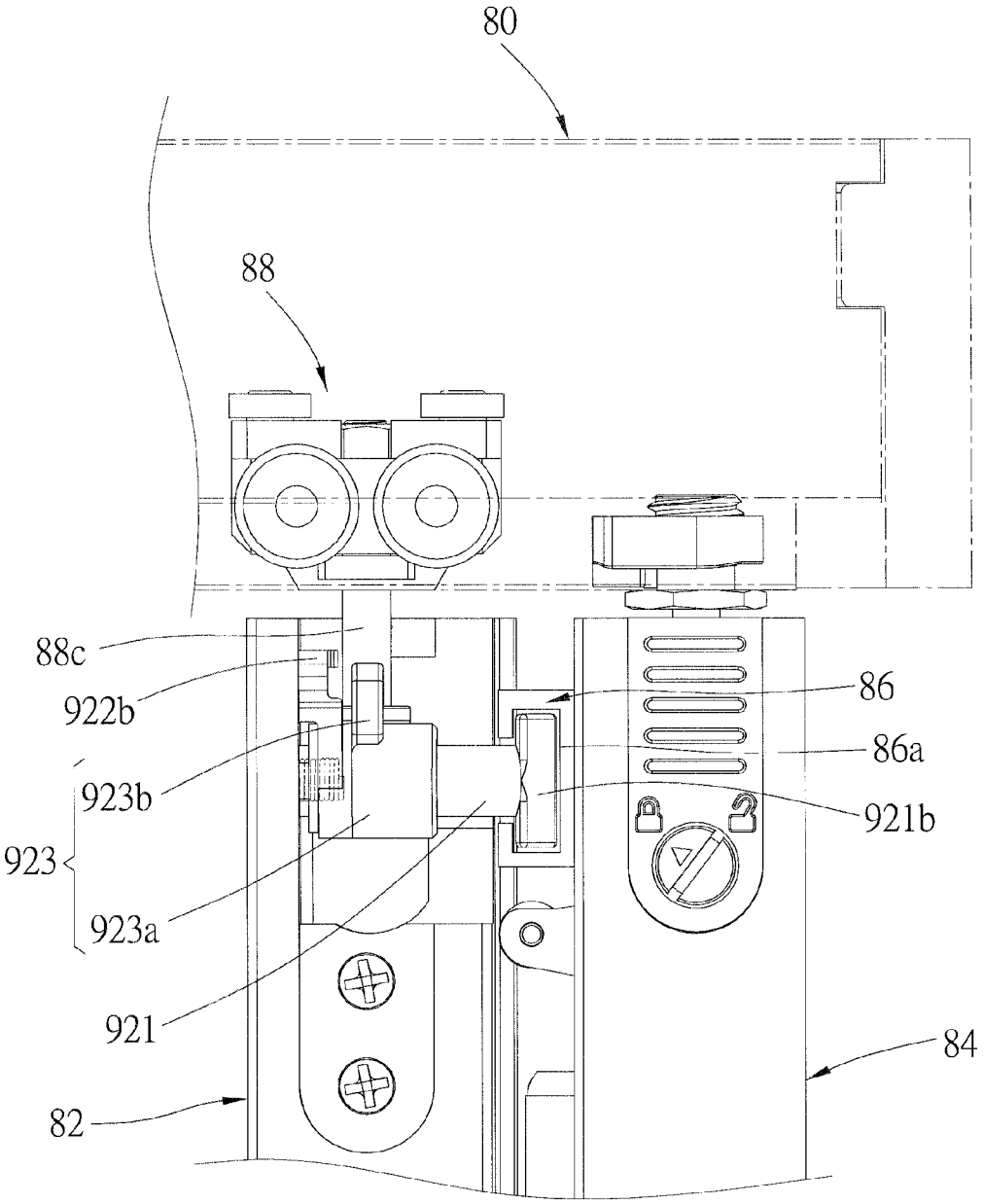
FIG. 30 is a lateral view of the third preferred embodiment of the present invention, showing the head of the tube against the inner sidewall of the slot.

While the rod 88*c* is moving the moving member 923, the tube 921 is moved together with the moving member 923 to the fourth position P4. At this time, the T-shaped connector 921*b* is turned to a vertical position as shown in FIG. 30 from a horizontal position and touches the inner sidewall of the slot 86*a* to engage the tube 921 with the locking base 86. As a result, it keeps the sashes 82, 84 in the folded condition while they are being moved toward the wall W, and keeps the moving member 923 staying at the fourth position P4.

On the contrary, when one moves the sashes 82, 84 back from the wall W, the rod 88*c* will enter the guiding slot 82*b* via the end opening 82*c*, and push the left hill portion of the guiding portion 923*b* to force the moving member 923 back to the third position P3. Next, when one moves the first sash 82 to unfold the sashes 82, 84, the pushing member 94 will push the movable unit 92 back to the first position P1, and at last, the sashes 82, 84 will close the opening.

Figure 31:
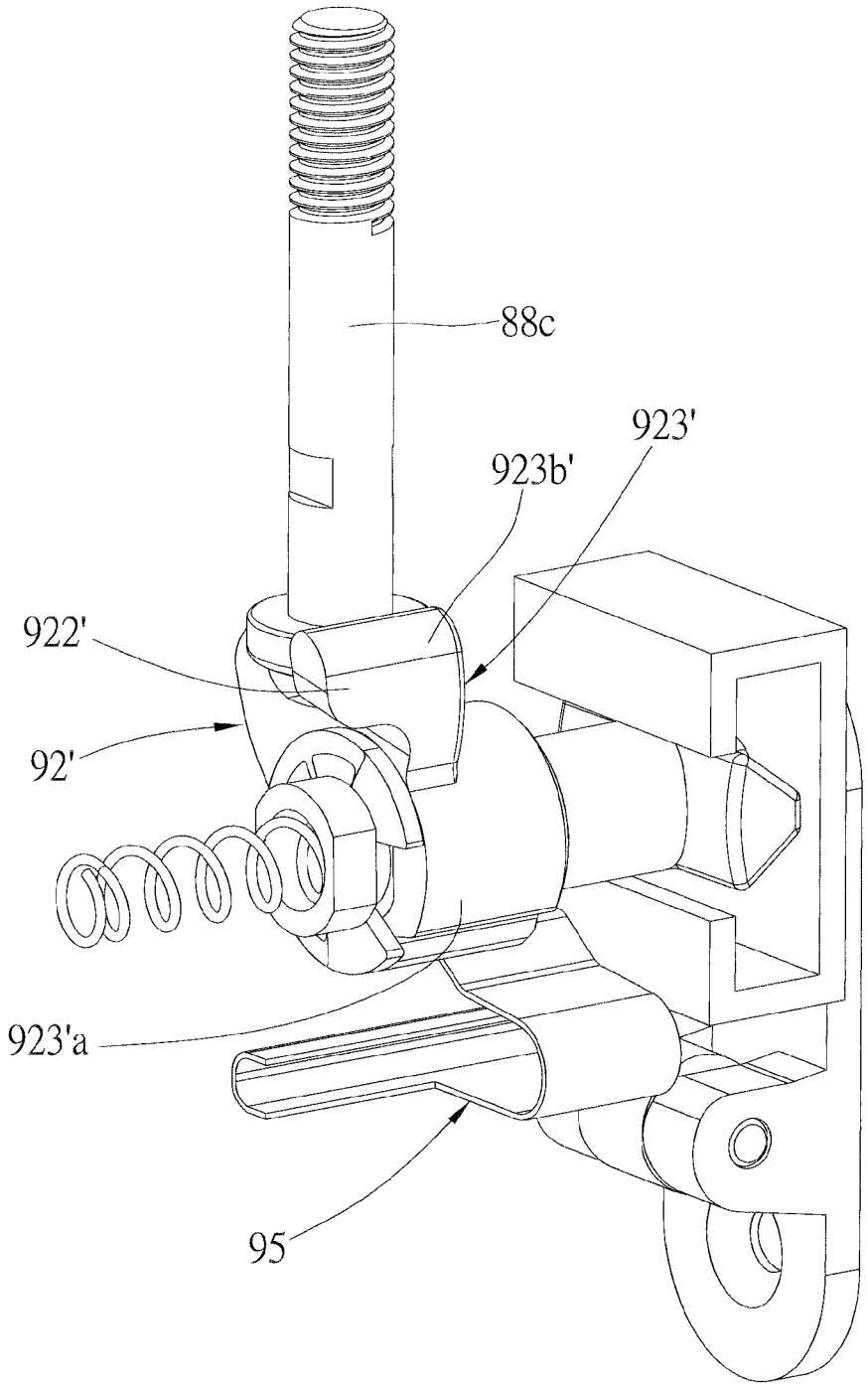
FIG. 31 is a perspective view of a fourth preferred embodiment of the present invention, showing the integrated stop member and moving member.
Figure 32:
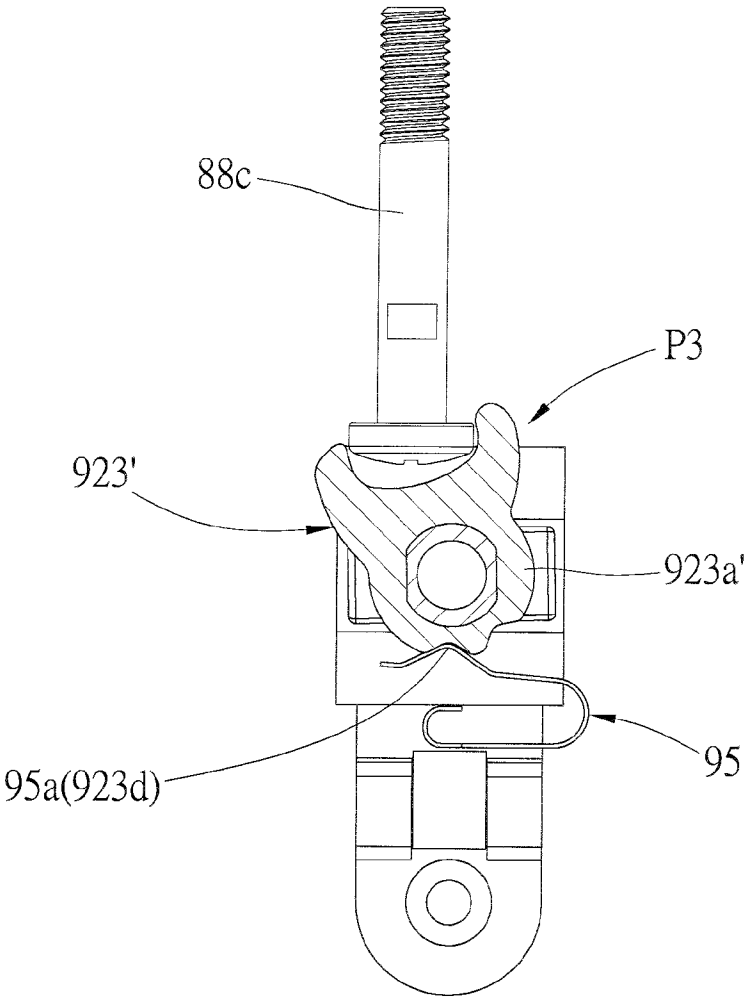
FIG. 32 is a lateral view of a fourth preferred embodiment of the present invention, showing the moving member at the third position.
Figure 33:
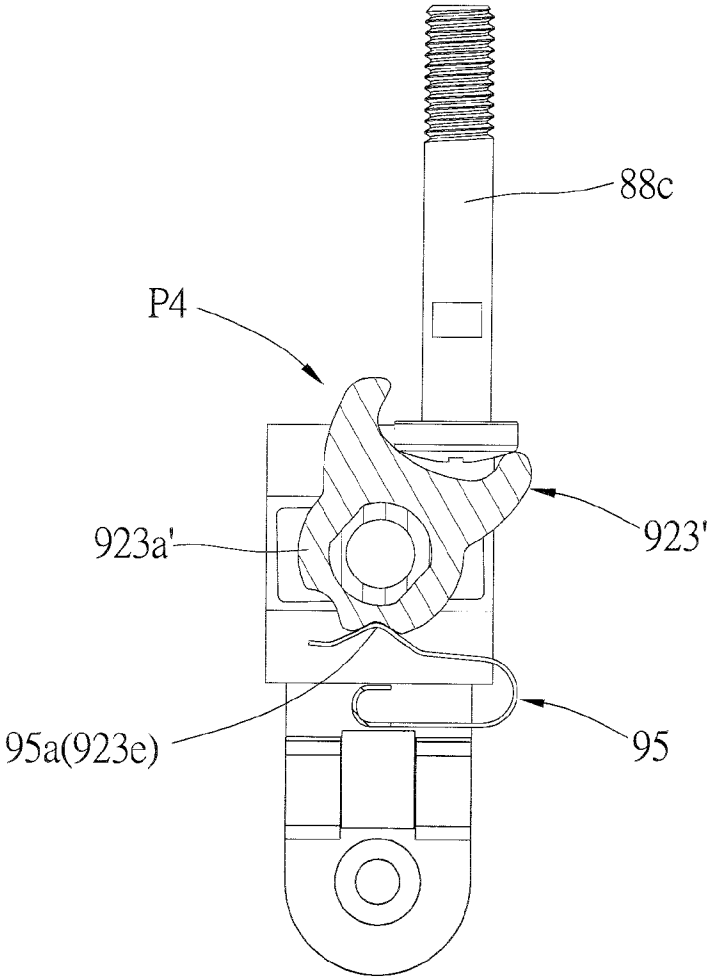
FIG. 33 is a lateral view of the fourth preferred embodiment of the present invention, showing the moving member at the fourth position.

FIG. 31 to FIG. 33 show a window covering of the fourth preferred embodiment of the present invention, which is similar to the third preferred embodiment, except that a movable unit 92' has a stop member 922', and the stop member 922' is a protrusion on a guiding portion 923*b*' of a moving member 923'. The function of the movable unit 92' is the same as above.

The window covering of the fourth preferred embodiment further includes a positioning member 95 in the first sash (FIG. 33). The positioning member 95 is a bent metal plate having a protrusion 95*a*. The moving member 923' has a first positioning slot 923*d* and a second positioning slot 923*e* at an outside of a pipe 923*a*'. The protrusion 95*a* of the positioning member 95 is engaged with the first positioning slot 923*d* to hold the moving member 923' at the third position P3. When the rod 88*c* pushes the moving member 923' to the fourth position P4 from the third position P3, the protrusion 95*a* of the positioning member 95 is engaged with the second positioning slot 923*e* to hold the moving member 923' at the fourth position P4. The purpose of the positioning member 95 and the positioning slots 923*d*, 923*e* is to stabilize the moving member 923', therefore they may be incorporate in the third preferred embodiment as well.

Figure 34:
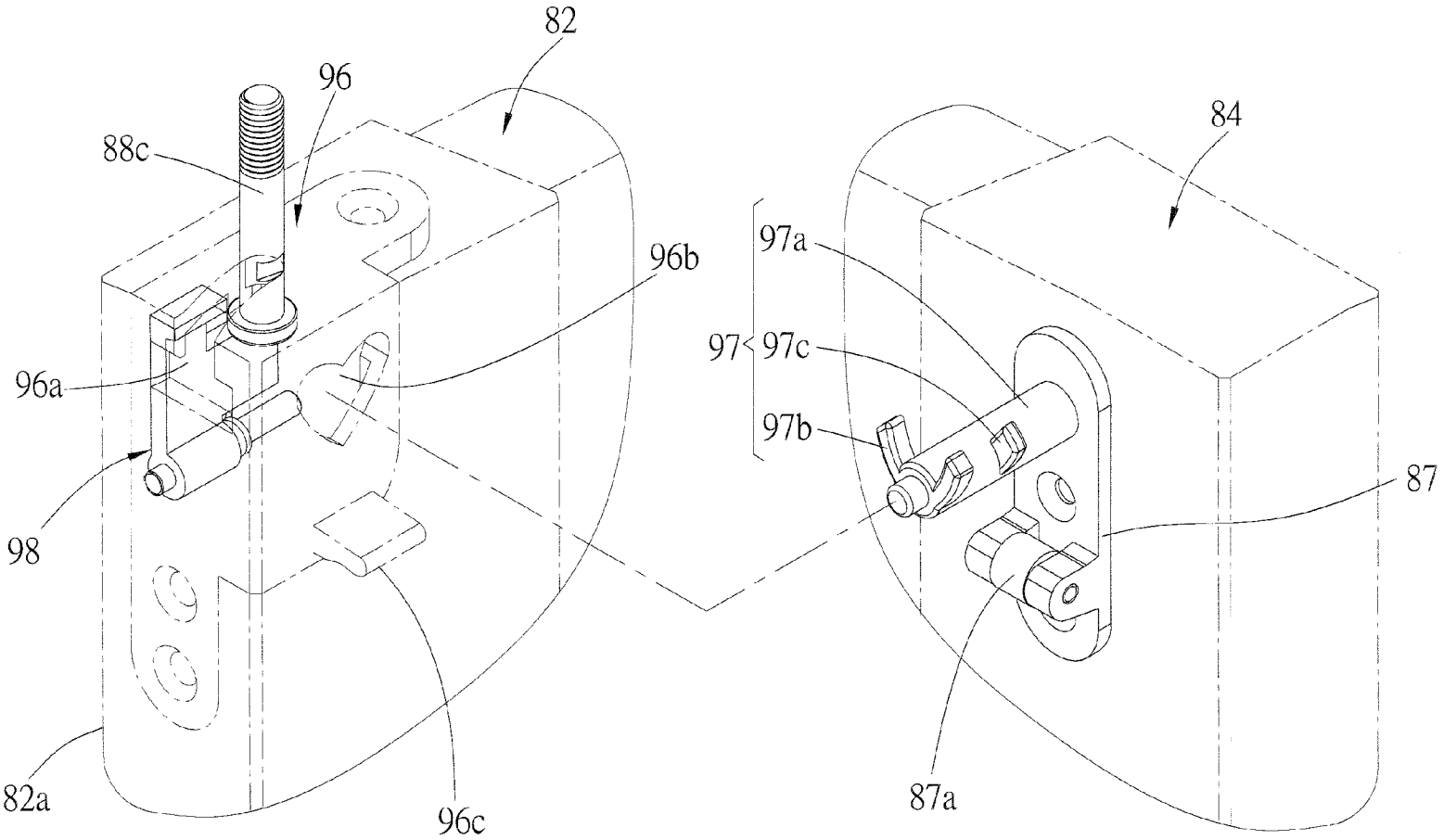
FIG. 34 is a perspective view of the fifth preferred embodiment of the present invention, showing the locking base and the moving member.
Figure 35:
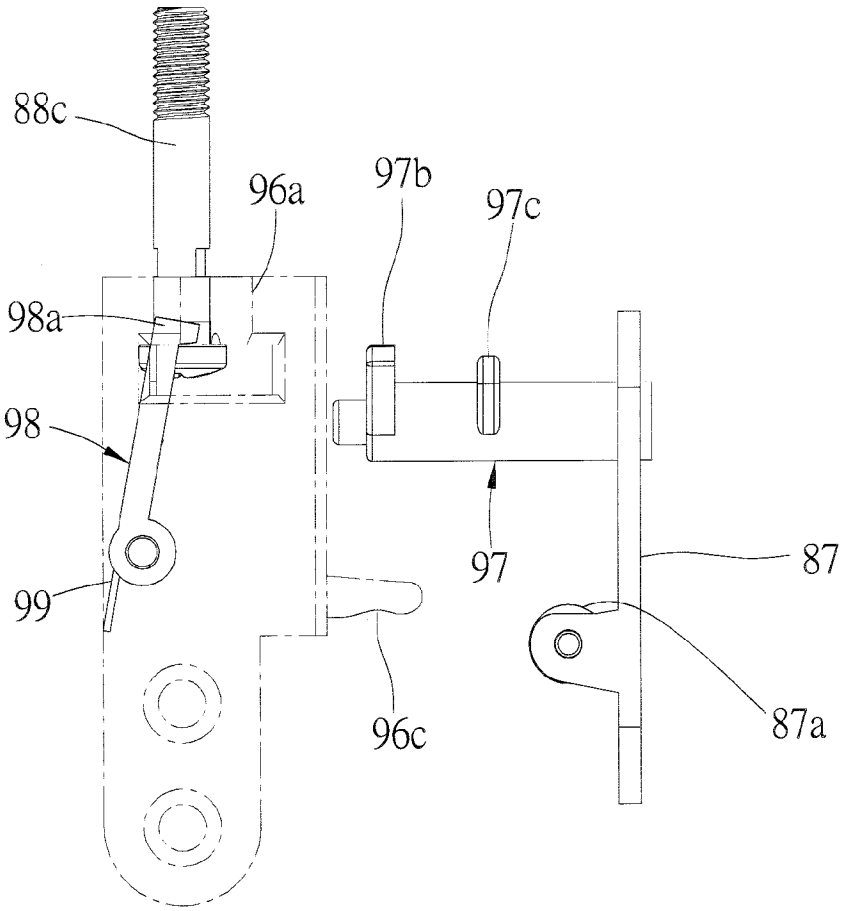
FIG. 35 is a lateral view of the fifth preferred embodiment of the present invention, showing the stop member not moved by the moving member.

FIG. 34 and FIG. 35 show a window covering of the fifth preferred embodiment, which is similar to above embodiments, except that a locking base 96 is provide on the sash frame 82*a* of the first sash 82, and a moving member 97 is pivotally connected to a fixed board 87 of the second sash 84. Precisely, the locking base 96 has a guiding slot 96*a* and a lateral bore 96*b*. The moving member 97 is a single unit, and has a body portion 97*a*, a guiding portion 97*b*, and a contacting portion 97*c*. The body portion 97*a* has an end passing through the fixed board 87. The pincer-like guiding portion 97*b* is on the other end of the body portion 97*a*, and the plate-like contacting portion 97*c* is on a middle portion of the body portion 97*a*. An elongated stop member 98 is provided in the sash frame 82*a* with an end pivoted on the locking base 96 to swing left and right. The stop member 98 has a stop portion 98*a* at a distal end. The stop member 98 is urged by a torsion spring 99 to engage the stop portion 98*a* with the guiding slot 96*a*.

Figure 36:
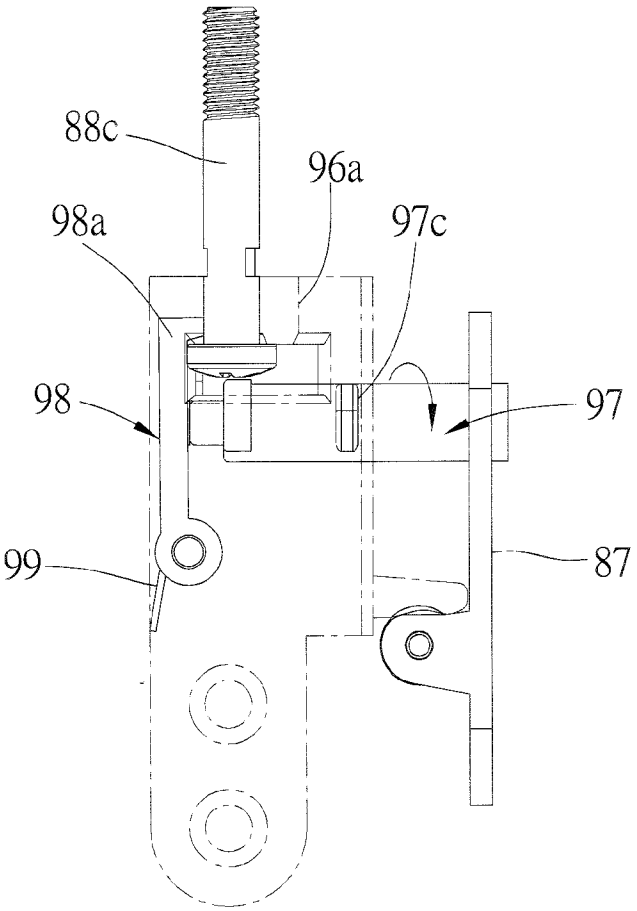
FIG. 36 is a lateral view of the fifth preferred embodiment of the present invention, showing the stop member moved by the moving member.

When the first sash 82 is moved toward the second sash 84 to fold them, and the folded sashes 82, 84 are substantially perpendicular to the rail (not shown), an end of the moving member 97 passes through the lateral bore 96*b* of the locking base 96 to push the stop member 98 away from a moving path of the rod 88*c*. At the same time, the guiding portion 97*b* of the moving member 97 touches the protrusion section 88*d* of the rod 88*c*. In the beginning of continuously moving folded sashes 82, 84 toward the wall W, the rod 88*c* drives the moving member 97 to turn, and then leaves the guiding slot 96*a*. It makes the contacting portion 97*c* touches the inner sidewall of the locking base 96 (FIG. 36). With an engagement of the contacting portion 97*c* of the moving member 97 and the locking base 96, it may keep the sashes 82, 84 in the folded-together condition while they are being moved toward the wall W.

The fixed board 87 is provided with a first contacting portion 87*a*, and the locking base 96 is provided with a second contacting portion 96*c*. In an embodiment, the first contacting portion 87*a* is a roller pivotally provided on the fixed board 87, and the second contacting portion 96*c* is a flexible plate horizontally projected from the locking base 96, and has a dent. While the moving member 97 is moving the stop member 98, the first contacting portion 87*a* touches the second contacting portion 96*c* (the roller engages the dent) to help securing the sashes 82, 84 in the folded condition.

The description above is only a few preferred embodiments of the present invention and the equivalence of the present invention is still in the scope of claim construction of the present invention.

What is claimed is:

1. A covering of a building opening, comprising:

a rail;

a first sash having a guiding slot which has an end opening;

a second sash hinged with the first sash with an end thereof, wherein the second sash pivots with another end thereof as a center of pivoting;

a pulley assembly movably received in the rail and having a rod, wherein the rod has a protrusion section exposed out of the rail, and the protrusion section enters and leaves the guiding slot through the end opening while the pulley assembly is moving; and a restricting assembly having a moving member and a locking base, wherein the moving member is provided on either the first sash or the second sash, and the locking base is correspondingly provided on the other; the moving member is contacted and moved by the rod to engage the locking base when the protrusion section of the rod leaves the guiding slot.

2. The covering as defined in claim 1, wherein the first sash has a sash frame, on which the guiding slot is provided; the moving member is provided in the sash frame and is movable between a first position, at which the moving member obstructs the guiding slot, and a second position, at which the moving member keeps the guiding slot clear; the moving member is away from the rod when the moving member is at the first position, and is contacted by the rod to be moved when the moving member is at the second position and the protrusion section of the rod is leaving the guiding slot; the locking base is provided on the second sash corresponding to the moving member.

3. The covering as defined in claim 2, wherein the restricting assembly has a tube, on which the moving member is provided; the moving member is turnable by the rod while the protrusion section of the rod is leaving the guiding slot, wherein when the moving member is not turned by the rod, where the moving member stays is defined as a third position; after the protrusion section of the rod leaves the guiding slot, the moving member is moved to a position which is defined as the fourth position; the tube has a contacting portion extending out of the sash frame; the locking base has a slot, and, when the first sash and the second sash are parallel to each other, the contacting portion is detachably engaged with the slot to move the moving member toward the second position.

4. The covering as defined in claim 3, wherein the tube is turnable along with the moving member when the moving member is contacted by the rod; the contacting portion of the tube has a connector; the connector enters the slot when the moving member is moved to the third position by folding the first and the second sashes and by contacting the rod, and touches an inner sidewall of the slot to make the tube unable to disengage the locking base when the moving member is moved to the fourth position by making the first and the second sashes parallel.

5. The covering as defined in claim 4, wherein the tube has an engaging section, and the moving member has a pipe and a guiding portion; the pipe has an engaging hole, which is complementary to the engaging section; the pipe is connected to the tube through an engagement of the engaging section and the engaging hole; the guiding portion is connected to the pipe to touch the protrusion section of the rod when the moving member is moved to the second position.

6. The covering as defined in claim 5, wherein the restricting assembly further has a positioning member provided in the sash frame of the first sash, and the moving member further includes a first positioning slot and a second positioning slot on an outer side of the pipe; the positioning member is engaged with the first positioning slot when the moving member is moved to the third position, and the positioning member is engaged with the second positioning slot to keep the moving member at the fourth position when the moving member is moved to the fourth position.

7. The covering as defined in claim 5, wherein the restricting assembly further has a stop member on a side of the moving member; the stop member restricts the rod in the guiding slot when the moving member is moved to the first position.

8. The covering as defined in claim 7, wherein the stop member is fitted to the tube and turns freely; a torsion spring is fitted to the tube to urge the stop member and the moving member respectively; the sash frame holds the stop member at a fixed position when the tube is turning, and the torsion spring urges the moving member toward the fourth position.

9. The covering as defined in claim 8, wherein the stop member has a ring and a block; the ring has a round hole to engage the tube, and the block is connected to the ring.

10. The covering as defined in claim 3, wherein the restricting assembly has a pushing member with opposite ends against an inner wall of the sash frame and the tube respectively; the pushing member drives the moving member toward the first position.

11. The covering as defined in claim 1, wherein the first sash has a sash frame; the locking base is connected to the sash frame of the first sash, and has the guiding slot and a lateral bore; the moving member is provided on the second sash for free rotation; a stop member restricts the rod in the guiding slot; when an end of the moving member passes through the lateral bore and moves the stop member, the rod is able to move the moving member while leaving the guiding slot.

12. The covering as defined in claim 11, wherein the moving member has a body portion, a guiding portion, and a contacting portion; the guiding portion and the contacting portion are connected to the body portion respectively; the body portion is connected to the second sash for free rotation; when the first and the second sashes are parallel to each other, the guiding portion touches the protrusion section of the rod, and the contacting portion touches an inner wall of the locking base when the moving member moves the stop member.

13. The covering as defined in claim 11, wherein the second sash has a fixed board, to which the moving member is connected; the fixed board has a first contacting portion, and the locking base has a second contacting portion; the first contacting portion touches the second contacting portion when the stop member is moved by the moving member.

14. A method of opening a covering of a building opening, wherein the covering comprises a rail, a first sash, a second sash, and a pulley assembly; the first sash is hinged with the second sash; the second sash pivots around a center of rotation at an end thereof; the pulley assembly movably received in the rail, wherein the first sash and the pulley assembly are provided with a rod and a guiding slot respectively; the guiding slot has an end opening; the rod is able to enter or leave the guiding slot via the end opening; and in a close condition the first sash and the second sash extend to close the opening; the method comprising the steps of:

moving the first sash toward the second sash until the first sash and the second sash are folded and substantially perpendicular to the rail, wherein the rod is received in the guiding slot when the first sash and the second sash are folded and substantially perpendicular to the rail;

moving the rod from the guiding slot to allow the first and the second sashes to be continuously moved; and continuously moving the first sash and the second sash to turn the first sash and the second sash around the center of rotation until the first sash and the second sash are totally off the opening.

15. The method as defined in claim 14, wherein the end opening of the guiding slot is closed before the first sash and the second sash are folded and substantially perpendicular to the rail, and after that the end opening of the guiding slot is opened.

16. The method as defined in claim 15, wherein the first sash and the second sash are kept in a folded condition while the first sash and the second sash are being moved off the opening.

17. The method as defined in claim 16, wherein the covering further includes a moving member and a locking base; the moving member is provided on one of the first sash and the second sash, and the locking base is provided on the other; the moving member is moved by the rod and engages the locking base when the rod leaves the guiding slot.

* * * * *